US008267129B2

(12) United States Patent
Doherty et al.

(10) Patent No.: US 8,267,129 B2
(45) Date of Patent: Sep. 18, 2012

(54) CONTROL OF FLUID TRANSFER OPERATIONS

(75) Inventors: Thom Doherty, Winnipeg (CA); Walter W. Eliuk, Winnipeg (CA); Richard L. Jones, Winnipeg (CA)

(73) Assignee: Intelligent Hospital Systems Ltd., Winnipeg (CA)

( * ) Notice: Subject to any disclaimer, the term of this patent is extended or adjusted under 35 U.S.C. 154(b) by 1272 days.

(21) Appl. No.: 11/937,846

(22) Filed: Nov. 9, 2007

(65) Prior Publication Data

US 2008/0114328 A1 May 15, 2008

Related U.S. Application Data

(60) Provisional application No. 60/971,815, filed on Sep. 12, 2007, provisional application No. 60/891,433, filed on Feb. 23, 2007, provisional application No. 60/865,105, filed on Nov. 9, 2006.

(51) Int. Cl.
*B65B 39/00* (2006.01)

(52) U.S. Cl. ..... 141/330; 141/1

(58) Field of Classification Search ..... 141/330, 141/25, 27, 95, 198, 2, 1; 53/451, 468
See application file for complete search history.

(56) References Cited

U.S. PATENT DOCUMENTS

| | | | |
|---|---|---|---|
| 3,878,967 | A | 4/1975 | Joslin et al. |
| 4,464,336 | A | 8/1984 | Hiramoto |
| 4,634,424 | A | 1/1987 | O'Boyle |
| 4,811,764 | A | 3/1989 | McLaughlin |
| 4,835,372 | A | 5/1989 | Gombrich et al. |
| 4,842,028 | A | 6/1989 | Kaufman et al. |
| 4,871,559 | A | 10/1989 | Dunn et al. |
| 4,910,942 | A | 3/1990 | Dunn et al. |
| 4,918,604 | A | 4/1990 | Baum |
| 4,993,598 | A | 2/1991 | Groninger |
| 5,020,958 | A | 6/1991 | Tuttobene |
| 5,034,235 | A | 7/1991 | Dunn et al. |
| 5,144,146 | A | 9/1992 | Wekhof |
| 5,208,762 | A | 5/1993 | Charhut et al. |
| 5,267,174 | A | 11/1993 | Kaufman et al. |

(Continued)

FOREIGN PATENT DOCUMENTS

CA 1317262 5/1993

(Continued)

OTHER PUBLICATIONS

Reply to Office Action in European Application serial No. 05855521.0, filed Jan. 8, 2010, pp. 15.

(Continued)

*Primary Examiner* — Davis Hwu
(74) *Attorney, Agent, or Firm* — Oblon, Spivak, McClelland, Maier & Neustadt, L.L.P.

(57) ABSTRACT

Some methods and related apparatus for manipulating a fluid conduit for insertion into a substantially re-sealable membrane include determining an orientation and position of a fluid conduit relative to the membrane. In an illustrative example, a syringe needle having a beveled leading edge may be manipulated by an automated device to be oriented and aligned with an aperture made upon a previous insertion of a needle into a membrane. In some examples, a predetermined number of insertions may be made in the same aperture by aligning and orienting one or more needles with the aperture. In some examples, multiple needle insertions may be controlled to produce apertures that are substantially spaced apart. Such procedures may, for example, advantageously extend the integrity of the membrane against leakage and/or contamination.

32 Claims, 8 Drawing Sheets

U.S. PATENT DOCUMENTS

| | | | |
|---|---|---|---|
| 5,319,543 | A | 6/1994 | Wilhelm |
| 5,337,919 | A | 8/1994 | Spaulding et al. |
| 5,341,854 | A | 8/1994 | Zezulka et al. |
| 5,348,585 | A | 9/1994 | Weston |
| 5,431,201 | A | 7/1995 | Torchia et al. |
| 5,479,969 | A | 1/1996 | Hardie et al. |
| 5,502,944 | A | 4/1996 | Kraft et al. |
| 5,533,606 | A | 7/1996 | Yuyama |
| 5,597,995 | A | 1/1997 | Williams et al. |
| 5,611,051 | A | 3/1997 | Pirelli |
| 5,635,394 | A | 6/1997 | Horn |
| 5,660,305 | A | 8/1997 | Lasher et al. |
| 5,666,410 | A | 9/1997 | McLane |
| 5,680,858 | A | 10/1997 | Hansen et al. |
| 5,700,998 | A | 12/1997 | Palti |
| 5,713,485 | A | 2/1998 | Liff et al. |
| 5,713,487 | A | 2/1998 | Coughlin |
| 5,744,094 | A | 4/1998 | Castberg et al. |
| 5,768,853 | A | 6/1998 | Bushnell et al. |
| 5,786,598 | A | 7/1998 | Clark et al. |
| 5,797,515 | A | 8/1998 | Liff et al. |
| 5,798,020 | A | 8/1998 | Coughlin et al. |
| 5,805,454 | A | 9/1998 | Valerino, Sr. et al. |
| 5,812,410 | A | 9/1998 | Lion et al. |
| 5,839,836 | A | 11/1998 | Yuyama et al. |
| 5,848,593 | A | 12/1998 | McGrady et al. |
| 5,884,457 | A | 3/1999 | Ortiz et al. |
| 5,900,211 | A | 5/1999 | Dunn et al. |
| 5,907,493 | A | 5/1999 | Boyer et al. |
| 5,912,818 | A | 6/1999 | McGrady et al. |
| 5,963,641 | A | 10/1999 | Crandall et al. |
| 5,971,593 | A | 10/1999 | McGrady |
| 5,993,046 | A | 11/1999 | McGrady et al. |
| 6,006,946 | A | 12/1999 | Williams et al. |
| 6,013,918 | A | 1/2000 | Bushnell et al. |
| 6,037,598 | A | 3/2000 | Cicha |
| 6,048,086 | A | 4/2000 | Valerino, Sr. |
| 6,060,022 | A | 5/2000 | Pang et al. |
| 6,068,156 | A | 5/2000 | Liff et al. |
| 6,108,588 | A | 8/2000 | McGrady |
| 6,155,485 | A | 12/2000 | Coughlin et al. |
| 6,181,979 | B1 | 1/2001 | Murakami |
| 6,181,982 | B1 | 1/2001 | Yuyama et al. |
| 6,202,004 | B1 | 3/2001 | Valerino, Sr. |
| 6,202,923 | B1 | 3/2001 | Boyer et al. |
| 6,203,535 | B1 | 3/2001 | Barney et al. |
| 6,249,774 | B1 | 6/2001 | Roden et al. |
| 6,318,630 | B1 | 11/2001 | Coughlin et al. |
| 6,355,024 | B1 | 3/2002 | Small et al. |
| 6,360,794 | B1 | 3/2002 | Turner |
| 6,370,841 | B1 | 4/2002 | Chudy et al. |
| RE37,829 | E | 9/2002 | Charhut et al. |
| 6,461,568 | B1 | 10/2002 | Eckhardt |
| 6,470,234 | B1 | 10/2002 | McGrady |
| 6,477,442 | B1 | 11/2002 | Valerino, Sr. |
| 6,482,176 | B1 | 11/2002 | Wich |
| 6,564,121 | B1 | 5/2003 | Wallace et al. |
| 6,566,659 | B1 | 5/2003 | Clark et al. |
| 6,592,816 | B1 | 7/2003 | Ebel et al. |
| 6,599,476 | B1 | 7/2003 | Watson et al. |
| 6,604,903 | B2 | 8/2003 | Osborne et al. |
| 6,616,771 | B2 | 9/2003 | Osborne et al. |
| 6,623,455 | B2 | 9/2003 | Small et al. |
| 6,673,048 | B1 | 1/2004 | Duchon et al. |
| 6,722,404 | B2 | 4/2004 | Osborne |
| 6,735,497 | B2 | 5/2004 | Wallace et al. |
| 6,847,861 | B2 | 1/2005 | Lunak et al. |
| 6,877,530 | B2 | 4/2005 | Osborne et al. |
| 6,883,681 | B1 | 4/2005 | Coughlin et al. |
| 6,915,823 | B2 | 7/2005 | Osborne et al. |
| 6,975,924 | B2 | 12/2005 | Kircher et al. |
| 6,976,349 | B2 | 12/2005 | Baldwin et al. |
| 6,985,870 | B2 | 1/2006 | Martucci et al. |
| 6,986,234 | B2 | 1/2006 | Liedtke |
| 6,991,002 | B2 | 1/2006 | Osborne et al. |
| 7,007,443 | B2 | 3/2006 | Liedtke et al. |
| 7,100,792 | B2 | 9/2006 | Hunter et al. |
| 7,108,679 | B2 | 9/2006 | Alchas |
| 7,117,902 | B2 | 10/2006 | Osborne |
| 7,260,447 | B2 | 8/2007 | Osborne et al. |
| 7,278,813 | B2 | 10/2007 | Davies et al. |
| 7,403,901 | B1 | 7/2008 | Carley et al. |
| 7,630,788 | B1 | 12/2009 | Reese |
| 2001/0018937 | A1 | 9/2001 | Nemoto |
| 2002/0146343 | A1 | 10/2002 | Jenkins et al. |
| 2002/0198738 | A1 | 12/2002 | Osborne |
| 2003/0097368 | A1 | 5/2003 | Tribble et al. |
| 2003/0216831 | A1 | 11/2003 | Hart et al. |
| 2004/0028553 | A1 | 2/2004 | Panico |
| 2004/0104243 | A1 | 6/2004 | Osborne et al. |
| 2004/0123567 | A1 | 7/2004 | McErlean et al. |
| 2004/0193317 | A1 | 9/2004 | Lunak et al. |
| 2004/0241041 | A1 | 12/2004 | Woodworth et al. |
| 2004/0249498 | A1 | 12/2004 | William et al. |
| 2004/0250842 | A1 | 12/2004 | Adams et al. |
| 2005/0045242 | A1 | 3/2005 | Osborne |
| 2005/0133729 | A1 | 6/2005 | Woodworth et al. |
| 2005/0224137 | A1 | 10/2005 | Tribble et al. |
| 2005/0236579 | A1 | 10/2005 | Jenkins et al. |
| 2005/0252572 | A1 | 11/2005 | Khan et al. |
| 2005/0252574 | A1 | 11/2005 | Khan et al. |
| 2005/0279419 | A1 | 12/2005 | Tribble et al. |
| 2006/0136095 | A1 | 6/2006 | Rob et al. |
| 2006/0224414 | A1 | 10/2006 | Astrup et al. |
| 2006/0225383 | A1 | 10/2006 | Cobb et al. |
| 2006/0259195 | A1 | 11/2006 | Eliuk et al. |
| 2009/0138340 | A1 | 5/2009 | Borr et al. |
| 2010/0017031 | A1 | 1/2010 | Rob et al. |

FOREIGN PATENT DOCUMENTS

| | | |
|---|---|---|
| DE | 4314657 | 11/1994 |
| IT | 01316152 | 3/2003 |
| WO | WO 97/43915 | 11/1997 |
| WO | WO 2006/069361 | 6/2006 |
| WO | WO 2006/124211 | 11/2006 |
| WO | WO 2008/058280 | 5/2008 |
| WO | WO 2008/101353 | 8/2008 |
| WO | WO2009/033283 | 3/2009 |
| WO | WO2009/062316 | 5/2009 |

OTHER PUBLICATIONS

EPO Extended European Search Report for EP Application No. 06751430.7 (PCT/US2006/015731), mailed Sep. 14, 2009, 7 pages.

Office Action in Re Exam Control No. 95/000,335; mailed Oct. 1, 2009 27 pages.

Re Exam Notification re Brief, Control No. 95/000,334; mailed Sep. 29, 2009 7 pages.

Re Exam Right of Appeal Notice, Control No. 95/000,333; mailed Dec. 2, 2009.

International Preliminary Report on Patentabililty, PCT/CA2008/000348, dated Sep. 3, 2009, 10 pages.

International Search Report and Written Opinion, PCT/CA2008/000348 dated Jun. 3, 2008, 11 pages.

Office Action in U.S. Appl. No. 11/316,795 notification date Dec. 29, 2008, 16 pages.

Office Action in U.S. Appl. No. 11/389,995 notification date Apr. 28, 2009, 8 pages.

Patent Owner's Entry in Reexam Control No. 95/000,333; filed Jan. 22, 2010; 32 pages.

Interview Summary in U.S. Appl. No. 11/316,795 notification date Feb. 24, 2009; 4 pages.

Reply to office action in U.S. Appl. No. 11/316,795 notification date Mar. 27, 2009; 14 pages.

Notice of Allowance in U.S. Appl. No. 11/316,795 mailing date Jun. 22, 2009; 6 pages.

Interview Summary in U.S. Appl. No. 11/389,995 notification date Jun. 17, 2009; 4 pages.

Reply to office action in U.S. Appl. No. 11/389,995 notification date Sep. 15, 2009; 14 pages.

Express Withdrawal of Appeal in Reexam control No. 95000334; filed Oct. 29, 2009; 4 pages.

Patent Owner Petition in Reexam control No. 95/000334; filed Nov. 10, 2009; 8 pages.

"BD Helping all people live health lives Prefilled. Proven. Preferred.," BD Product Literature, BD, 2000.
International Search Report and Written Opinion, PCT/CA2008/002027 dated Feb. 25, 2009, 12 pages.
Office Action in Re Exam Control No. 95/000,333; mailed May 5, 2009; 43 pages.
Office Action in Re Exam Control No. 95/000,336; mailed Oct. 15, 2008; 21 pages.
Office Action in Re Exam Control No. 95/000,340; mailed Mar. 30, 2009; 69 pages.
Office Action in Re Exam Control No. 95/000,345; mailed Mar. 30, 2009; 67 pages.
Patent Owner's Response in Re Exam Control No. 95/000,333; filed Jun. 16, 2009, 16 pages.
Patent Owner's Response in Re Exam Control No. 95/000,345; filed Apr. 29, 2009, 8 pages.
Third Party Comments on Patent Owner Response in Reexam Control No. 95/000,333; filed Jul. 16, 2009; 11 pages.
Office Action in Re Exam Control No. 95/000,345; mailed Jul. 2, 2009 73 pages.
Office Action in Re Exam Control No. 95/000,340; mailed Jul. 20, 2009, 8 pages.
U.S. Appl. No. 60/865,105, filed Nov. 9, 2006.
U.S. Appl. No. 60/891,433, filed Feb. 23, 2007.
U.S. Appl. No. 60/971,815, filed Sep. 12, 2007.
Wekhof, "Basic Definitions and Data for Electron Beam Sterilization," SteriBeam Systems, GmbH, 2005, 2 pages.
Biomedical Technology Consulting, "05BTC—Cytocare: Automatic system for the preparation of cytostatic drugs," 2005, 22 pgs. (includes English translation).
Wekhof, "Disinfection with Flash Lamps," *PDA Journal of Pharmaceutical Science & Technology*, 2000, 54(3):264-276.
Wekhof, "Does the Engineering of the PureBright Sterilisation System Match the Pulsed Light Sterilisation Process?" Advanced Ultra-Fast Sterilisation from SteriBeam Systems GmbH, Kehl, Germany, 2001, http://www.steribeam.com/articles/WTPP-Rep/html, 6 pages.
"Industrial Automated Pulsed UV Modules," Advanced Pulsed UV and Corona Systems from SteriBeam GmbH, Kehl, Germany, http://www.steribeam.com/f-scale.puv, printed Jan. 25, 2008, 1 page.
Wekhof et al., "Pulsed UV Disintegration (PUVD): a new sterilization mechanism for packaging and broad medical-hospital applications," *The First International Conference on Ultraviolet Technologies*, Jun. 14-16, 2001, Washington, D.C., 15 pages.
Cote and Torchia, "Robotic system for i.v. antineoplastic drug preparation: Description and preliminary evaluation under simulated conditions" *Am. J. Hosp. Pharm.*, 1989, 46:2286-2293.
"Two Uv-flashlamps R&D/Labor Automated System," Advanced Pulsed UV and Corona Systems From SteriBeam GmbH, Kehl, Germany, http://www.steribeam.com/xe-labor-wt.html, printed Mar. 24, 2006, 2 pages.
Office Action in Re Exam Control No. 95/000,335; mailed Mar. 7, 2008; 31 pages.
Patent Owner's Response in Re Exam Control No. 95/000,335; filed Jun. 7, 2008, 34 pages.
Request for InterPartes Reexamination in Reexam Control No. 95/000,335; filed Jan. 11, 2008; 73 pages.
Office Action in Re Exam Control No. 95/000,334; mailed Feb. 27, 2008; 17 pages.
Request for InterPartes Reexamination in Reexam Control No. 95/000,334; filed Jan. 11, 2008; 54 pages.
Office Action in Re Exam Control No. 95/000,333; mailed Mar. 7, 2008; 36 pages.
Patent Owner's Response in Re Exam Control No. 95/000,333; filed Jun. 12, 2008, 11 pages.
Patent Owner's Response in Re Exam Control No. 95/000,333; filed Jun. 7, 2008, 38 pages.
Request for InterPartes Reexamination in Reexam Control No. 95/000,333; filed Jan. 11, 2008; 39 pages.
Office Action in Re Exam Control No. 95/000,336; mailed Mar. 11, 2008; 36 pages.
Patent Owner's Response in Re Exam Control No. 95/000,336; filed Jun. 12, 2008, 13 pages.
Patent Owner's Response in Re Exam Control No. 95/000,336; filed Jun. 7, 2008, 44 pages.
Request for InterPartes Reexamination in Reexam Control No. 95/000,336; filed Jan. 11, 2008; 97 pages.
Office Action in Re Exam Control No. 95/000,342; mailed Mar. 11, 2008; 18 pages.
Patent Owner's Response in Re Exam Control No. 95/000,342; filed Jun. 7, 2008, 33 pages.
Request for InterPartes Reexamination in Reexam Control No. 95/000,342; filed Jan. 11, 2008; 89 pages.
Office Action in Re Exam Control No. 95/000,340; mailed Mar. 21, 2008; 43 pages.
Patent Owner's Response in Re Exam Control No. 95/000,340; filed Jun. 12, 2008, 10 pages.
Patent Owner's Response in Re Exam Control No. 95/000,340; filed May 20, 2008, 39 pages.
Request for InterPartes Reexamination in Reexam Control No. 95/000,340; filed Jan. 30, 2008; 33 pages.
Third Party Comments on Patent Owner Response in Reexam Control No. 95/000,340; filed Jun. 19, 2008; 19 pages.
Patent Owner's Response in Re Exam Control No. 95/000,345; filed Jun. 23, 2008, 32 pages.
Office Action in Re Exam Control No. 95/000,345; mailed Apr. 23, 2008; 110 pages.
Request for InterPartes Reexamination in Reexam Control No. 95/000,345; filed Feb. 11, 2008; 32 pages.
Office Action mailed Jun. 5, 2012, in Chinese Patent Application No. 200780048871.9.
Office Action mailed Jun. 13, 2012, in Japanese Patent Application No. 2009-536523 (with English language translation).

CONTROL OF FLUID TRANSFER OPERATIONS

CROSS-REFERENCE TO RELATED APPLICATIONS

This application claims priority under 35 U.S.C. §119(e) to U.S. Provisional Patent Application Ser. No. 60/971,815, entitled "Gripper Device," and filed on Sep. 12, 2007, U.S. Provisional Patent Application Ser. No. 60/891,433, entitled "Ultraviolet Disinfection In Pharmacy Environments," and filed on Feb. 23, 2007, and U.S. Provisional Patent Application Ser. No. 60/865,105, entitled "Control of Needles for Fluid Transfer," and filed on Nov. 9, 2006, and the entire contents of each of which are herein incorporated by reference. The entire contents of U.S. patent application Ser. No. 11/316,795, entitled "Automated Pharmacy Admixture System," and filed by Rob, et al. on Dec. 22, 2005, and U.S. patent application Ser. No. 11/389,995, entitled "Automated Pharmacy Admixture System," and filed by Eliuk, et al. on Mar. 27, 2006, are each herein incorporated by reference.

TECHNICAL FIELD

This instant specification relates to controlling fluid transfer operations among medicinal containers such as syringes, vials, and IV bags.

BACKGROUND

Many medications are delivered to a patient from an intravenous (IV) bag into which a quantity of a medication is introduced. Sometimes, the medication may be an admixture with a diluent. In some cases, the IV bag contains only the medication and diluent. In other cases, the IV bag may also contain a carrier or other material to be infused into the patient simultaneously with the medication. Medication can also be delivered to a patient using a syringe.

Medication is often supplied, for example, in powder form in a medication container or in a vial. A diluent liquid may be supplied for making an admixture with the medication in a separate or diluent container or vial. A pharmacist may mix a certain amount of medication (e.g., which may be in dry form such as a powder) with a particular amount of a diluent according to a prescription. The admixture may then be delivered to a patient.

One function of the pharmacist is to prepare a dispensing container, such as an IV bag or a syringe, which contains a proper amount of diluent and medication according to the prescription for that patient. Some prescriptions (e.g., insulin) may be prepared to suit a large number of certain types of patients (e.g., diabetics). In such cases, a number of similar IV bags containing similar medication can be prepared in a batch, although volumes of each dose may vary, for example. Other prescriptions, such as those involving chemotherapy drugs, may require very accurate and careful control of diluent and medication to satisfy a prescription that is tailored to the needs of an individual patient.

The preparation of a prescription in a syringe or an IV bag may involve, for example, transferring fluids, such as medication or diluent, among vials, syringes, and/or IV bags. IV bags are typically flexible, and may readily change shape as the volume of fluid they contain changes. IV bags, vials, and syringes are commercially available in a range of sizes, shapes, and designs.

SUMMARY

In general, this document describes controlling fluid transfer operations among medicinal containers such as syringes, vials, and IV bags.

Some methods and related apparatus for manipulating a fluid conduit for insertion into a substantially re-sealable membrane include determining an orientation and position of a fluid conduit relative to the membrane. In an illustrative example, a syringe needle having a beveled leading edge may be manipulated by an automated device to be oriented and aligned with an aperture made upon a previous insertion of a needle into a membrane. In some examples, a predetermined number of insertions may be made in the same aperture by aligning and orienting one or more needles with the aperture. In some examples, multiple needle insertions may be controlled to produce apertures that are substantially spaced apart. Such procedures may, for example, advantageously extend the integrity of the membrane against leakage and/or contamination.

Some methods and related apparatus for controlling a syringe type fluid transfer device during a fluid transfer from a reservoir to the syringe type fluid transfer device include performing a predetermined sequence of draw and expel operations. In an illustrative example, a syringe type fluid transfer device having a plunger may be manipulated by an automated device to actuate the plunger and draw or expel fluid into or from the syringe type fluid transfer device. Such procedures may advantageously, for example, substantially minimize or eliminate gas (e.g., air) within the syringe type fluid transfer device during a fluid transfer operation.

In a first aspect, an automated method of providing fluid communication through a self-sealing membrane includes a) operating an articulated conveyor to retrieve a first fluid conduit having a beveled leading edge. The method further includes b) creating a first aperture in a re-sealable fluid port membrane by piercing the membrane with the first fluid conduit. The method further includes c) operating the articulated conveyor to retrieve an additional fluid conduit having a beveled leading edge. The method further includes d) determining alignment and orientation of the additional fluid conduit relative to the first aperture. The method further includes e) registering and orienting the additional fluid conduit for entry into the first aperture. The method further includes f) inserting the additional fluid conduit through the first aperture and in substantial alignment with the first aperture.

Implementations may include any, all, or none of the following features. The method can include beginning to perform step d) before beginning to perform step c). The method can include repeating steps c) through f) at least two times. Step f) can include inserting the additional fluid conduit without substantially enlarging the first aperture. The method can include transferring a fluid through the additional fluid conduit while the additional fluid conduit is inserted in the first aperture. The method can include transferring a fluid through the first fluid conduit while the first fluid conduit is inserted in the first aperture.

The re-sealable fluid port membrane can substantially prevent fluid leakage while holding a differential pressure of at least 5 pounds-force per square inch gauge (psig) after at least ten insertions. The fifteenth fluid conduit can remain inserted in the re-sealable fluid port membrane while holding the differential pressure.

The first fluid conduit can include a needle. The first fluid conduit can include a cannula. The re-sealable fluid port membrane can include a vial bung. The re-sealable fluid port membrane can include an intravenous (IV) bag fluid port. The fluid port membrane can seal an opening of a fluid reservoir. The fluid reservoir can include a vial. The fluid reservoir can include an intravenous (IV) bag. The fluid reservoir can include a flexible fluid conduit. The fluid reservoir can include a rigid container. The first fluid conduit can be the same as at least one of the additional fluid conduits.

The method can include discarding the first fluid conduit and retrieving the second fluid conduit. The method can include creating a second aperture in the re-sealable fluid port membrane by piercing the membrane with another fluid conduit having a beveled leading edge.

Step d) can include determining an orientation of the beveled leading edge of the additional fluid conduit. Step d) further can include rotating the beveled edge of the additional fluid conduit to be in substantial register with the first aperture. The method can include positioning the fluid conduit to be a predetermined distance from the surface of the re-sealable fluid port membrane.

In a second aspect, a computer program product tangibly embodied in a computer readable medium includes instructions that, when executed, perform operations for providing fluid communication through a self-sealing membrane. The operations include causing an articulated conveyor to retrieve a first fluid conduit having a beveled leading edge. The operations further include creating a first aperture in a re-sealable fluid port membrane by piercing the membrane with the first fluid conduit. The operations further include causing the articulated conveyor to retrieve an additional fluid conduit having a beveled leading edge. The operations further include determining alignment and orientation of the additional fluid conduit relative to the first aperture. The operations further include registering and orienting the additional fluid conduit for entry into the first aperture. The operations further include inserting the additional fluid conduit through the first aperture and in substantial alignment with the first aperture.

In a third aspect, a method of repeatedly accessing a fluid container to permit fluid transfer includes a) selecting a first location and orientation to insert a leading tip for needles having a beveled leading edge. The method further includes b) repeatedly inserting a leading tip of at least one needle at the selected first location and orientation. The method further includes c) after performing step b) a predetermined number of times, selecting a second location and orientation to insert a leading tip for at least one needle having a beveled leading edge, wherein a first aperture formed by inserting a needle at the selected first location and orientation will be substantially spaced apart from a second aperture formed by inserting a needle at the selected second location and orientation. The method further includes d) positioning a leading tip of a needle for insertion at the selected second location and orientation.

Implementations may include any, all, or none of the following features. Selecting a second location can include identifying a location at which the second aperture is substantially outside of a predefined keep-out region around the first aperture. The method can include inserting a leading tip of at least one needle at the selected second location and orientation. Step b) can include making a plurality of insertions with at least two different needles. Step d) can include making a plurality of insertions with at least two different needles. The method can include: e) after performing step d) a second predetermined number of times, selecting a third location and orientation to insert a leading tip for at least one needle having a beveled leading edge, wherein the first and second apertures will be substantially spaced apart from a third aperture formed by insertion of a needle at the selected third location and orientation. The method can include: f) positioning a leading tip of a needle for insertion at the selected third location and orientation. The first and second apertures can be made by insertion of needles through a substantially self-sealing membrane.

In a fourth aspect, a computer program product tangibly embodied in a computer readable medium includes instructions that, when executed, perform operations for repeatedly accessing a fluid container to permit fluid transfer. The operations include selecting a first location and orientation to insert a leading tip for needles having a beveled leading edge. The operations further include repeatedly inserting a leading tip of at least one needle at the selected first location and orientation. The operations further include after performing step b) a predetermined number of times, selecting a second location and orientation to insert a leading tip for at least one needle having a beveled leading edge, wherein a first aperture formed by inserting a needle at the selected first location and orientation will be substantially spaced apart from a second aperture formed by inserting a needle at the selected second location and orientation. The operations further include positioning a leading tip of a needle for insertion at the selected second location and orientation.

In a fifth aspect, an automated method of providing fluid communication through a self-sealing membrane includes a) determining whether an aperture has been made in a membrane, the aperture being made by piercing the membrane with a fluid conduit having a beveled leading edge. The method further includes b) upon determining that the membrane has at least one aperture, performing one of the following operations: causing a second fluid conduit to be oriented and registered to be inserted through and in substantial alignment with one of the identified apertures, or identifying a second location and orientation and causing the needle to be inserted at the second location and orientation such that the resulting aperture is substantially spaced apart from any other aperture that has been made in the membrane.

Implementations may include any, all, or none of the following features. The operations in step b) can include aborting a requested needle insertion into the membrane. The method can include retrieving information stored in an electronic data storage module, the retrieved information comprising location and orientation information for at least one previous fluid conduit insertion. The retrieved information can include information associated with physical characteristics for each of the at least one previously inserted fluid conduits.

The systems and techniques described here may provide one or more advantages. For example, controlling an insertion location of a needle in a vial stopper and the bevel orientation of the needle may provide a reduction in the amount of damage to the vial stopper (e.g., resulting in leakage or contamination) for multiple insertions of the needle into the vial. In another example, performing a sequence of draws and expels to remove gas from a syringe type fluid transfer device during a fluid transfer operation can provide improved accuracy in measuring a dose of medication.

The details of one or more embodiments are set forth in the accompanying drawings and the description below. Other features and advantages will be apparent from the description and drawings, and from the claims.

DESCRIPTION OF DRAWINGS

Like reference symbols in the various drawings indicate like elements.

DETAILED DESCRIPTION

This document describes systems and techniques for controlling fluid transfer operations among medicinal containers such as syringes, vials, and IV bags. The systems and techniques may be used during admixture or compounding and dispensing of drug doses, such as in an automated pharmacy admixture system (APAS). An example of an APAS is described with reference to FIGS. 1 through 5 in U.S. patent application Ser. No. 11/316,795, filed by Rob, et al. on Dec. 22, 2005, and with reference to FIGS. 1 through 5 in U.S. patent application Ser. No. 11/389,995, filed by Eliuk, et al. on Mar. 27, 2006, the entire contents of each of which are herein incorporated by reference. An example of an apparatus for controlling fluid transfer between a fluid transfer device and a container or conduit is described with reference to FIGS. 1 through 6 in U.S. Provisional Patent Application Ser. No. 60/865,105, filed by Doherty, et al. on Nov. 9, 2006, the entire contents of which are herein incorporated by reference.

Figure 1:
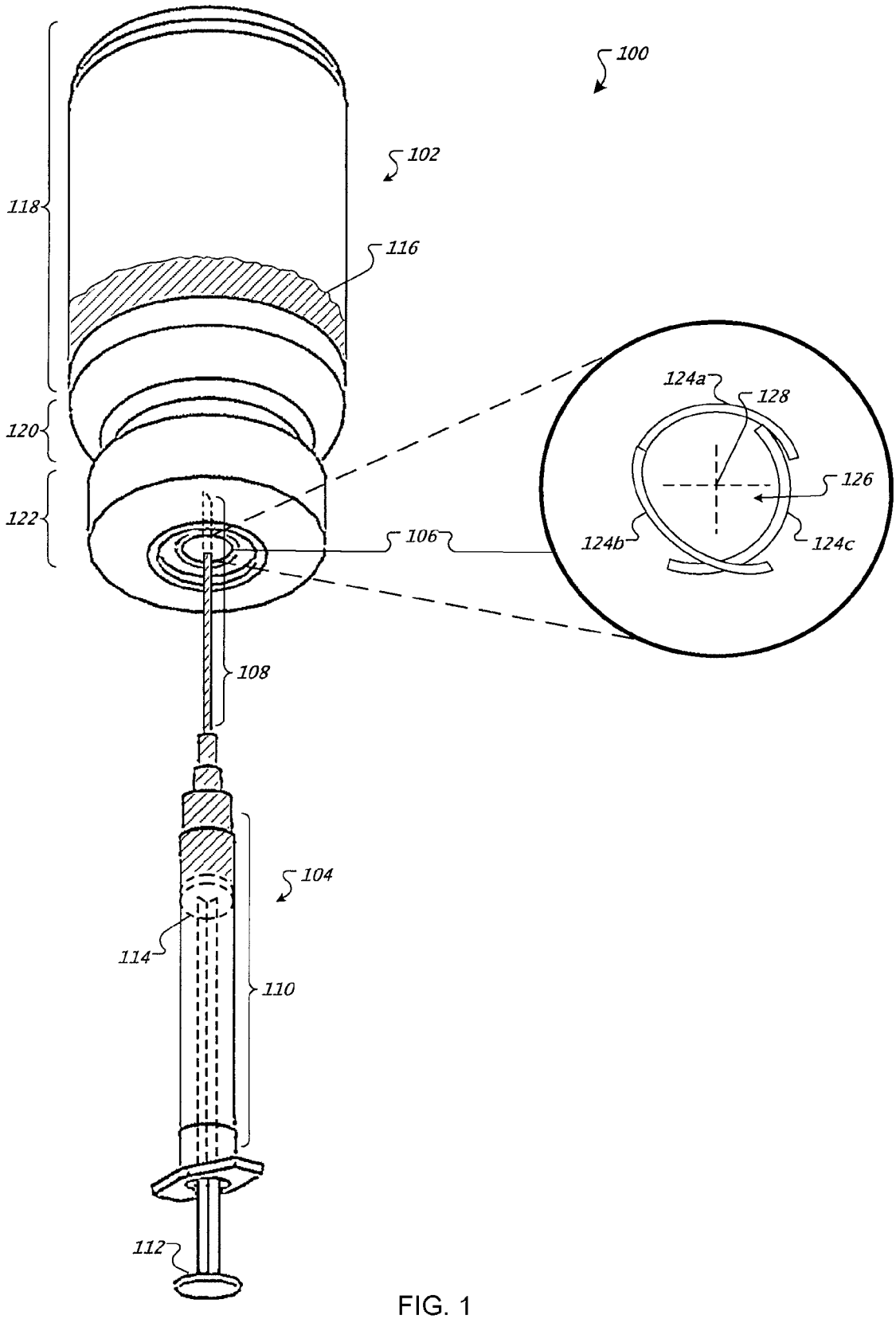
FIG. 1 shows an example of a system for fluid transfer between a container and a fluid transfer device.

FIG. 1 shows an example of a system 100 for fluid transfer between a container 102 and a fluid transfer device 104. The container 102 includes a fluid transfer port 106. The fluid transfer device 104 includes a needle 108 for puncturing and/or insertion into the fluid transfer port 106. Once inserted, the fluid transfer device 104 can transfer fluid to and from the container 102.

While shown here as a syringe, the fluid transfer device 104 can be another type of device. For example, the fluid transfer device 104 can be a fluid conduit, such as a tube that is fitted with a needle. In general, a fluid transfer device includes a fluid conduit (e.g., needle or cannula) for insertion into a substantially self-sealing membrane that forms a fluid transfer port of a fluid container or reservoir (e.g., vial, IV bag, flexible conduit).

In the example shown here, the fluid transfer device 104 includes a body region 110, a plunger 112, and a piston 114 in addition to the needle 108. The piston 114 creates a longitudinally slidable seal with the inside surface of the body region 110. The piston 114 substantially prevents fluid from leaking through the body region 110 as the plunger 112 is drawn out or pushed in. In the depicted needle-up orientation, an opening at the end of the needle 108 is immersed in fluid below a fluid level 116 in the container 102. In this configuration, withdrawing the plunger 112 out of the body region 110 tends to draw fluid from the container 102 into the fluid transfer device 104. Pushing the plunger 112 into the body region 110 tends to push fluid from the fluid transfer device 104 toward the container 102. The shaded regions indicate fluid within the fluid transfer device 104 and the container 102.

In some implementations, air pressure within the container 102 is maintained by first pushing a volume of air into the container 102 from the fluid transfer device 104 before drawing fluid from the container 102 into the fluid transfer device 104. In some implementations, the air and fluid volumes exchanged are substantially the same. In some other implementations, a replacement air volume may be chosen such that the container 102 remains at a substantially negative or positive pressure relative to ambient pressure after a fluid transfer between the fluid transfer device 104 and the container 102.

While the container 102 in the depicted example is a drug vial, the container 102 can be, for example, a flexible container, such as an IV fluid bag or an elastomeric bag, which may be supported by a cup or cylinder. In some other examples, the fluid transfer device 104 can be used to transfer fluid to or from a conduit (e.g., medical tubing or catheter). For example, the fluid transfer device 104 can be used to transfer fluid to or from a tube connected to an IV fluid bag or an IV catheter.

In the example depicted in FIG. 1, the container 102 includes a body region 118, a neck region 120, and a cap region 122. In this example, the cap region 122 includes the fluid transfer port 106. The fluid transfer port 106 allows for insertion of the needle 108 to transfer fluid to and from the container 102. The fluid transfer port 106 provides a seal that can inhibit or substantially prevent fluid leakage and/or air exchange into or from the container 102 before a needle insertion, while a needle is inserted, and after a needle is removed from the fluid transfer port 106. In some implementations, the fluid transfer port 106 can include a material such as rubber, plastic, or silicone to allow insertion of a needle and subsequent substantial re-sealing of an aperture resulting from the needle insertion. For example, a fluid transfer port can be a vial bung having a rubber stopper. In another example, a fluid transfer port can be a silicone septum or membrane connected to a fluid conduit.

The needle 108 of this example has a beveled leading edge to facilitate insertion into the fluid transfer port 106. Accordingly, each insertion of the needle 108 either creates an insertion aperture or enters through an existing insertion aperture, in whole or in part. An insertion aperture may have a substantially arc-shaped presentation associated with the beveled leading edge of each inserted needle. In the exploded view of FIG. 1, multiple needle apertures 124*a-c* are shown. In this example, the needle apertures 124*a-c* are substantially arc-shaped.

In various examples, uncontrolled needle insertions may compromise the seal provided by the fluid transfer port 106. As shown in the exploded view, the needle apertures 124*a-c* created by repeated uncontrolled insertion of the needle 108 into the fluid transfer port 106 can potentially result in coring a hole in a region 126 defined by the circular pattern of the needle apertures 124*a-c* in the fluid transfer port 106.

In some other examples, uncontrolled insertions may produce a pattern of apertures that may substantially compromise the integrity of the fluid transfer port 106 to provide a seal against fluid and/or gas leakage. In some implementations, damage can occur after only two uncontrolled insertions, such as joined insertions (e.g., the needle apertures 124*a-b*) and intersecting insertions (e.g., the needle apertures 124*b-c*). A leakage path and/or damage can occur, for example, where the container 102 and the fluid transfer device 104 are aligned along a center axis 128 and the fluid transfer device 104 undergoes uncontrolled rotation about the center axis 128 between the insertions of the needle. Furthermore, where apertures resulting from two uncontrolled insertions intersect or join, the ability of the fluid transfer port 106 to substantially seal around either an inserted needle or self-seal after the needle has been removed may be substantially reduced. For example, a hole or damage to a fluid transfer port can result in leakage of fluid or air from a container or conduit. A hole or damage to a fluid transfer port can also result in contamination of the contents of the container or conduit.

Figure 2A:
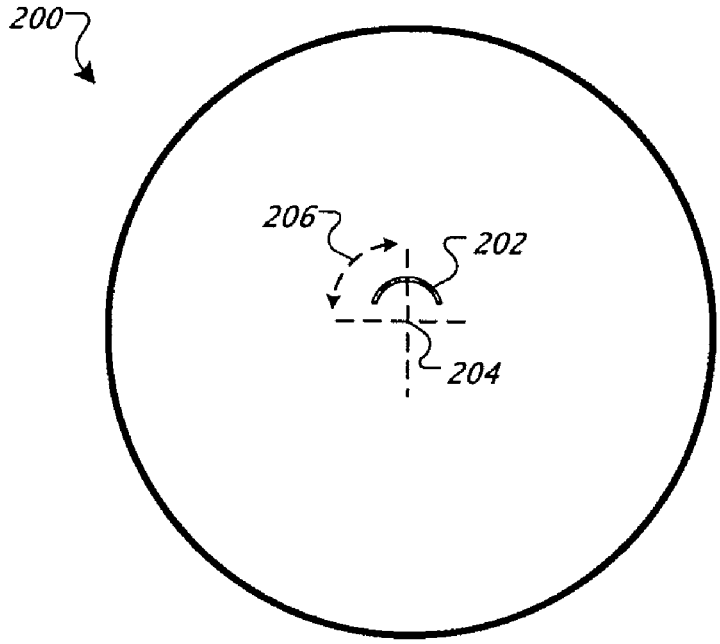
FIG. 2A shows an example of a fluid transfer port that includes a needle aperture.

FIG. 2A shows an example of a fluid transfer port 200 that includes a needle aperture 202. The needle aperture 202 can be used for multiple insertions of a needle (not shown). One or more fluid transfer devices can be used to perform the insertions and subsequent fluid transfers. A location of needle insertions (e.g., along a center axis 204 of the needle) and a rotation (as indicated by arrows 206) of a bevel tipped needle about the center axis 204 can be controlled. Controlling the location and rotation allows multiple needle insertions using substantially the same aperture (e.g., the needle aperture 202).

In some implementations, the insertion location and the needle rotation can be substantially the same for each needle insertion into the fluid transfer port 200. For example, an angular orientation (e.g., rotation around a longitudinal axis of a syringe) of a needle bevel may be within about one, five, ten, fifteen, or twenty degrees in either direction to allow subsequent insertions using the needle aperture 202. In another example, an insertion location of a needle may be within about 0.1, 0.2, 0.3, 0.4, 0.5, 0.6, 0.7, 0.8, 0.9, 1.0, 1.5, 2.0 millimeter in any direction in the plane of the fluid transfer port 200 to allow subsequent insertions using the needle aperture 202. In addition to the insertion location and the needle rotation, the angle at which a needle is incident upon the plane of the fluid transfer port 200 can be substantially the same for each needle insertion.

In some implementations, the acceptable deviation in angular rotation and/or insertion location can be dependent on the type of fluid transfer port or needle used. For example, a rubber fluid transfer port may have a lower tolerance for deviation in location and/or rotation than a plastic fluid transfer port. In another example, a needle with a large diameter (or gauge) may have a higher tolerance for deviation in location and/or rotation than a needle with a small diameter. In a further example, a needle with a standard bevel may have a lower tolerance for deviation in location and/or rotation than a needle with a short bevel.

In some implementations, a subsequent insertion of a needle may be rotated about the needle aperture 202 by one hundred and eighty degrees. For example, the fluid transfer port 200 at the needle aperture 202 may stretch or form around the needle to substantially maintain the fluid seal. In some implementations, the rotation deviation tolerances previously described may also apply to a needle rotated by one hundred and eighty degrees. In some implementations, a needle rotated by one hundred and eighty degrees has an insertion location that is substantially the same as the center axis 204 of the needle aperture 202. In some implementations, a needle rotated by one hundred and eighty degrees may have an insertion location that places the bevel tip of the needle at the needle aperture 202. In some implementations, a knife blade or non-coring needle may be rotated by one hundred and eighty degrees and inserted into an existing aperture.

Figure 2B:
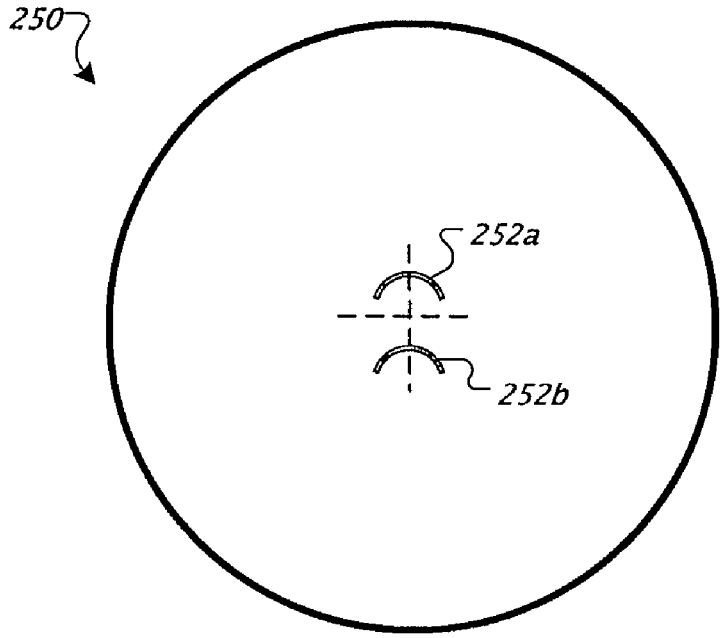
FIG. 2B shows an example of a fluid transfer port that includes multiple needle apertures.

FIG. 2B shows an example of a fluid transfer port 250 that includes multiple apertures 252*a-b*. In some implementations, insertion locations and/or orientations of a needle can be controlled such that the apertures 252*a-b* are substantially spaced apart so that apertures do not intersect or join. For example, where a known number of insertions are performed and the fluid transfer port 250 includes sufficient surface area, the locations and/or orientations of the apertures 252*a-b* can be controlled such that they are substantially spaced apart.

In some implementations, the aperture 252*a* may be created and reused for a particular number of insertions before creating and reusing the aperture 252*b*. For example, an aperture may be automatically reused for a predetermined number of needle insertions before forming or re-using another aperture. In another example, a digitally controlled syringe manipulator may control each of a number of insertions to be located to be substantially separated from existing apertures.

In another example, the number, pattern, spacing, and/or orientation of insertions can be predetermined based on properties of the needle or cannula (e.g., needle gauge or bevel angle) and/or the fluid transfer port (e.g., type of material or thickness of material). A more durable fluid transfer port material may allow more needle insertions than a fluid transfer port having a less durable material. A large gauge needle may result in faster degradation of the fluid transfer port than a needle having a small gauge.

In some implementations, the acceptable number of insertions in an aperture can be based on a status of the fluid transfer port 250. For example, a camera can be used to generate an image of a surface of the fluid transfer port 250. The image can be analyzed to determine if damage at an aperture is imminent or if the integrity of the fluid transfer port 250 has degraded at the aperture.

Figure 3B:
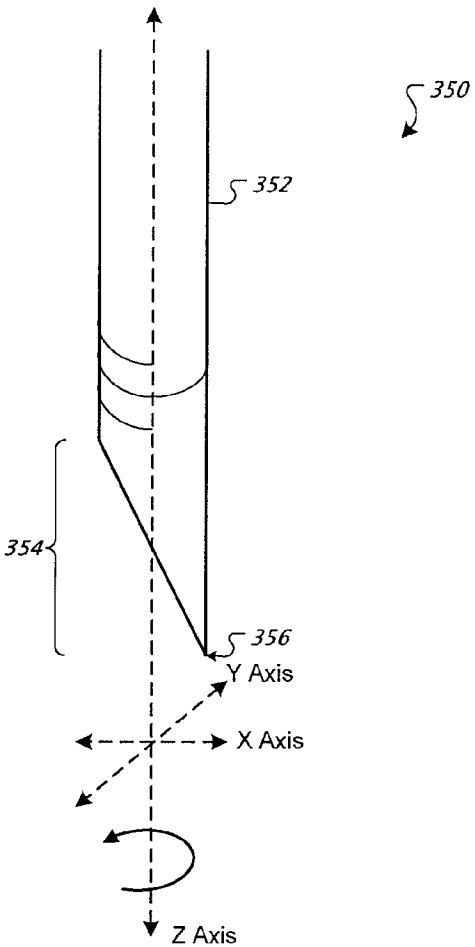
FIG. 3B shows a view of a needle after a controlled orientation.
Figure 3A:
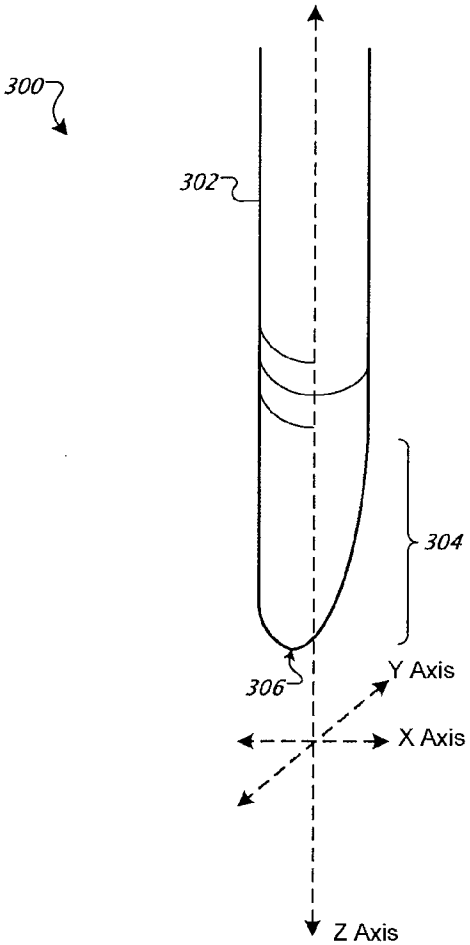
FIG. 3A shows a view of a needle before a controlled orientation.

FIG. 3A shows a view 300 of a needle 302 before a controlled orientation. The needle 302 includes a beveled tip 304. The beveled tip 304 is capable of creating an aperture in a fluid transfer port. During insertion into the fluid transfer port, the needle 302 is positioned at a particular location in the x-y plane. In addition, the needle 302 may be oriented so that the beveled tip 304 is at a particular angular rotation about the z-axis. For example, a camera can generate an image of the beveled tip 304. The image can be analyzed to determine how much to rotate the needle 302 about the z-axis to consistently insert the needle 302 at the same angular rotation in a particular fluid transfer port.

For example, image analysis can locate a position of a needle point 306. The rotation of the needle 302 can be determined using the location of the needle point 306. In another example, the curvature of the beveled tip 304 can be analyzed. The rotation needed to orient the needle 302 can be determined based on the curvature or shape of the beveled tip 304. The rotation can be calculated based on an image from a first view. In some implementations, the needle 302 can be rotated in at least one direction until the needle point 306 reaches a particular location and/or the beveled tip 304 reaches a particular shape. In another example, at least two images may be taken with the needle being rotated a known angle between images. The multiple images at different angles may be analyzed using image processing software to estimate the orientation of the beveled tip 304.

FIG. 3B shows a view 350 of a needle 352 after a controlled orientation. The needle 352 has been rotated about the z-axis to a controlled angular orientation. In some implementations, the needle 352 is rotated so that a beveled tip 354 of the needle 352 has a particular profile or shape, such as the straight line of the beveled tip 354 shown here. In some implementations, the needle 352 is rotated so that a needle point 356 is at a particular position, such as particular distance from the z-axis. The profile of the beveled tip 354 and/or the position of the needle point 356 may be based on the type of needle used. For example, different bevel types can have different profiles.

In another example, a needle having a larger diameter than the needle 352 shown here can have a different needle point position than the needle 352.

Figure 4A:
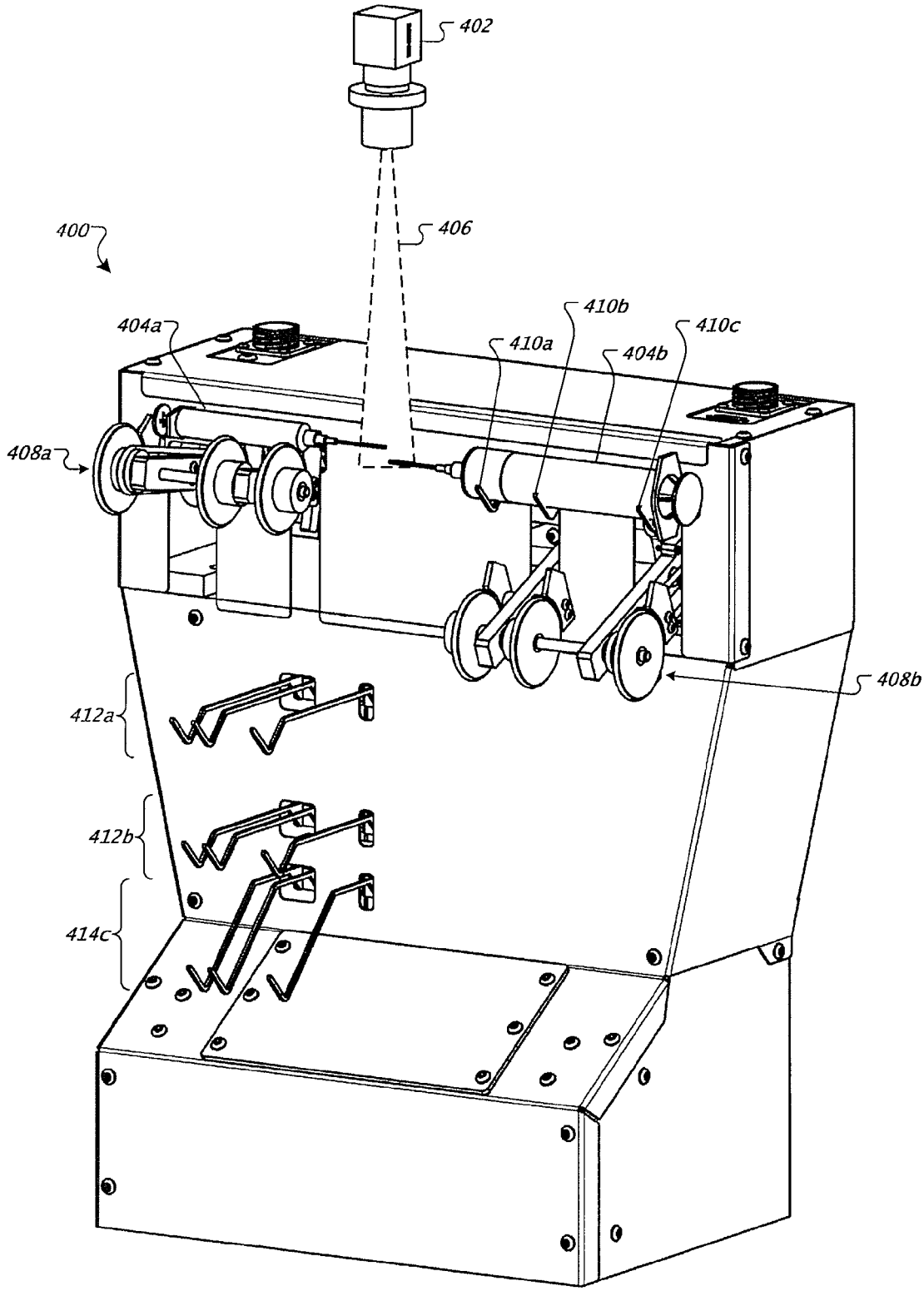
FIG. 4A shows an example of a bevel orientation device.

FIG. 4A shows an example of a bevel orientation device 400. The bevel orientation device 400 orients a beveled tip of a needle by rotating a fluid transfer device attached to the needle in response to information from a camera 402. The bevel orientation device 400 can hold one or more fluid transfer devices 404*a-b*. The beveled tips of the needles are within a field of view of the camera 402, as indicated by a dashed line 406. The camera 402 generates images of the beveled tips. The rotation of the fluid transfer devices 404*a-b* is as previously described. Particularly, a rotation may be calculated based on an image generated by the camera 402. In some implementations, a fluid transfer device may be rotated until a subsequent image from the camera 402 includes a particular property, such as a beveled tip shape or a needle point position. Needle point position information may include a length of the needle, for example, with respect to a reference point feature on the barrel of a syringe, for example. The image information may be processed to provide for accurate control of needle insertion depth, for example, in addition to accurate location and orientation of the bevel. Control of needle depth may advantageously improve the insertion depth profile of the needle. In a needle inserted to withdraw fluid from a vial, the needle tip insertion depth may be controlled so that the needle tip extends substantially through the membrane to provide fluid communication with fluid in the vial, while minimizing the insertion depth of the needle to maximize the amount of fluid that can be extracted from the vial.

The bevel orientation device 400 includes a roller arms 408*a-b*. The roller arms 408*a-b* include rollers that, when in contact with the body region of a fluid transfer device, can rotate the fluid transfer device. The roller arm 408*a* is engaged on the body region of the fluid transfer device 404*a*. The roller arm 408*b* is disengaged from the body region of the fluid transfer device 404*b*.

The bevel orientation device 400 includes multiple support arms 410*a-c*. The fluid transfer device 404*b* is placed in the support arms 410*a-c*. For example, a robotic arm can place the fluid transfer device 404*b* in the support arms 410*a-c*. In some implementations, the support arms 410*a-c* are attached to a scale (not shown). The scale allows the weight of the fluid transfer device 404*b* to be measured. In some implementations, the weight of the fluid transfer device 404*b* is measured before a fluid transfer operation using the support arms 410*a-c* and the scale. Examples of weighing operations are described with reference to FIG. 3 in U.S. patent application Ser. No. 11/316,795, filed by Rob, et al. on Dec. 22, 2005, and U.S. patent application Ser. No. 11/389,995, entitled "Automated Pharmacy Admixture System," and filed by Eliuk, et al. on Mar. 27, 2006, the contents of which are incorporated herein by reference.

The bevel orientation device 400 includes multiple scale arms 412*a-c*. The scale arms 412*a-c* are attached to a scale (not shown). In some implementations, the weight of the fluid transfer device 404*b* is measured before and/or after a fluid transfer operation using, for example, the support arms 410*b* and the scale. The weight of the fluid transfer device 404*b* before and/or after a fluid transfer operation can be used to determine the success of the transfer operation.

For example, an expected weight of material transferred to or from the fluid transfer device 404*b* can be calculated based on the amount of the material transferred. The expected weight can be compared to the difference between the weights of the fluid transfer device 404*b* before and after the transfer. If the difference is within a predefined tolerance, then the transfer can be considered successful. Otherwise, if the difference in weights differs from the expected weight by more than the threshold, then the transfer can be considered unsuccessful. An unsuccessful transfer can result in, for example, generating an electronic message to notify an operator of the failure, repeating the transfer using the same fluid transfer device and container, or repeating the transfer using a different fluid transfer device and/or container.

Figures 4B, 4C, 4D:
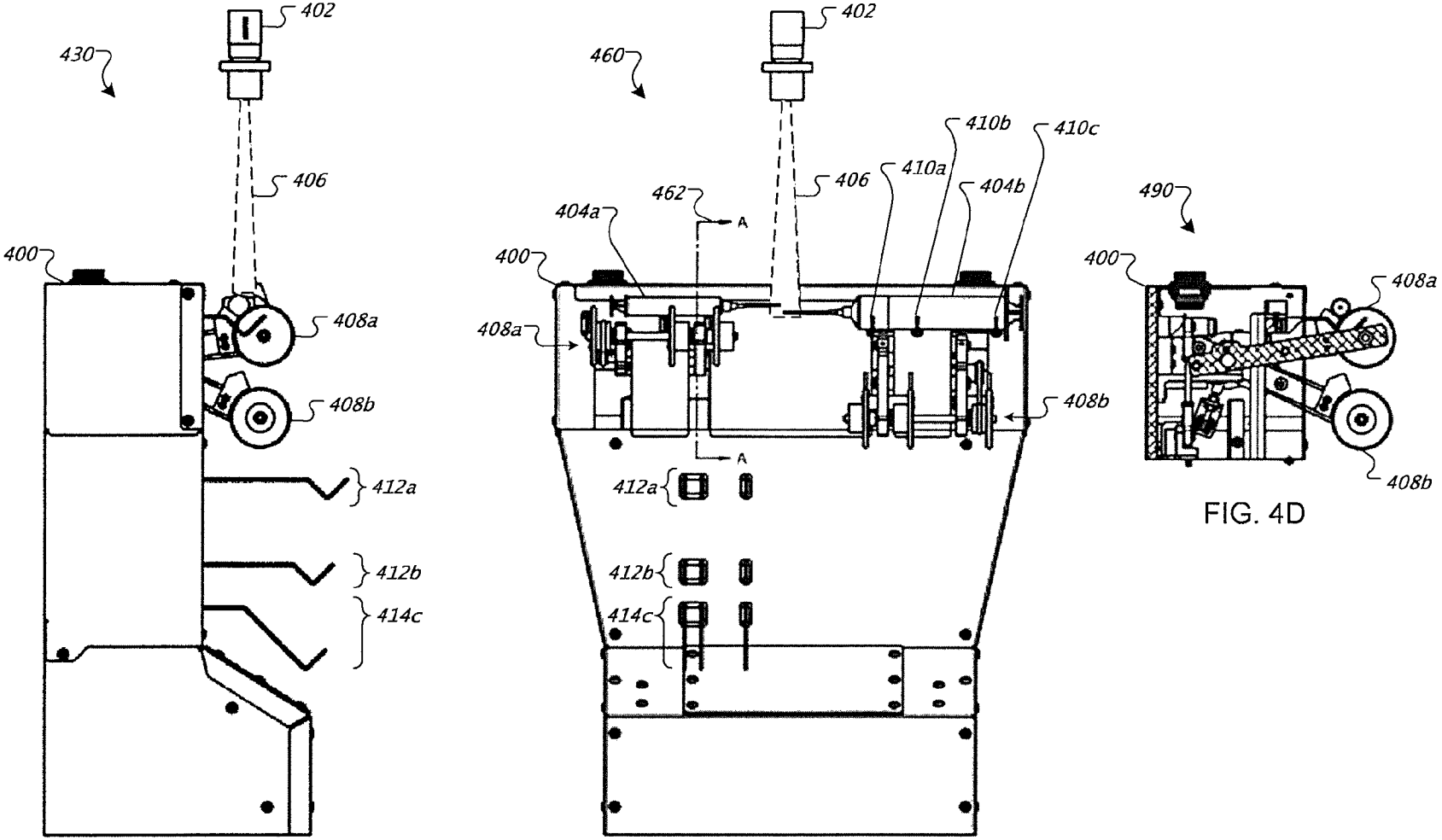
FIG. 4B is a side view of the bevel orientation device.
FIG. 4C is a front view of the bevel orientation device.
FIG. 4D is a cross section of the bevel orientation device.

FIG. 4B is a side view 430 of the bevel orientation device 400. The side view 430 of the bevel orientation device 400 shows the camera 402, the roller arms 408*a-b*, and the scale arms 412*a-c*. As shown, the scale arms 412*a-c* can accommodate fluid transfer devices of different sizes and/or shapes.

FIG. 4C is a front view 460 of the bevel orientation device 400. The front view 460 of the bevel orientation device 400 shows the camera 402, the fluid transfer devices 404*a-b*, the roller arms 408*a-b*, the support arms 410*a-c*, and the scale arms 412*a-c*. A dashed line 462 indicates a region and direction of view for a cross section 490 shown in FIG. 4D.

FIG. 4D is the cross section 490 of the bevel orientation device 400. The cross section 490 shows the roller arms 408*a-b*. The cross section 490 also shows components within the bevel orientation device, such as a drive motor for rotating the roller arm wheels and an actuator to engage or disengage the roller arms 408*a-b* from the fluid transfer devices 404*a-b*, respectively.

In some implementations, a robotic arm (not shown) transports a fluid transfer device, a container, and/or a conduit between apparatuses, such as the bevel orientation device 400, a needle insertion apparatus, and an ultra-violet (UV) disinfection apparatus. An example of a UV disinfection system is described with reference to FIGS. 24 though 30 in U.S. Provisional Patent Application Ser. No. 60/891,433, filed by Davidson, et al. on Feb. 23, 2007, the entire contents of which are herein incorporated by reference.

In some implementations, a needle bevel may be passively oriented. For example, the beveled needle tip of a fluid transfer device may be brought into contact with a sloped surface. The sloped surface may have substantially the same angle or slope as the bevel of the needle. The fluid transfer device may be allowed to rotate about the z-axis such that bringing the beveled needle into contact with the sloped surface causes the needle bevel to align with the sloped surface and correspondingly rotates the fluid transfer device. In some implementations, the fluid transfer device is vertical while aligning the needle bevel in this manner. In some implementations, the fluid transfer device is lowered onto the sloped surface. In some implementations, the sloped surface may be brought into register with the beveled needle to orient the needle. In some implementations, an external vibration may be applied to the fluid transfer device to promote alignment with the sloped surface.

In some implementations, a needle bevel can be aligned with specific features on the fluid transfer device such that registering the fluid transfer device (e.g., a body region of the fluid transfer device) provides orientation of the needle bevel. This may be performed prior to loading the fluid transfer device into an apparatus for inserting the needle into a container or conduit. For example, a marking or surface feature on the fluid transfer device may be determined using, for example, imaging methods as previously described. The fluid transfer device can be rotated in the z-axis or translated along the z-axis based on the determined marking or surface feature of the fluid transfer device. Correspondingly, the needle bevel is also oriented. An example of a system for performing these operations is described with reference to FIG. 24 in U.S.

patent application Ser. No. 11/389,995, entitled "Automated Pharmacy Admixture System," and filed by Eliuk, et al. on Mar. 27, 2006.

In some implementations, oriented fluid transfer devices can be stored in a rotating carousel. An example of a rotating carousel is described with respect to FIGS. 3 through 5 of U.S. patent application Ser. No. 11/389,995, entitled "Automated Pharmacy Admixture System," and filed by Eliuk, et al. on Mar. 27, 2006, which is herein incorporated by reference. In one example, a robotic arm may transport an oriented fluid transfer device from the bevel orientation device 400 to the rotating carousel for storage. In some implementations, the rotating carousel maintains the orientation of stored fluid transfer devices such that a fluid transfer device may be removed from the rotating carousel and placed in an apparatus for inserting a needle of the fluid transfer device into a container or conduit.

In one example, a robotic arm can transport the fluid transfer device 404*a* from the bevel orientation device 400 to an apparatus that inserts a needle of the fluid transfer device 404*a* into a container or conduit. In an illustrative example, the hand off between the robotic arm, the bevel orientation device 400, and the apparatus for inserting the needle results in the angular rotation of the needle with respect to the container or conduit being controlled to within about 1.0, 2.0, 3.0, 4.0, 5.0, 10.0, 15.0, 20.0, or 25.0 degrees. Subsequently, the apparatus performs a fluid transfer operation between the fluid transfer device 404*a* and the container or conduit, such as by actuating a plunger of the fluid transfer device 404*a*.

Figure 5:
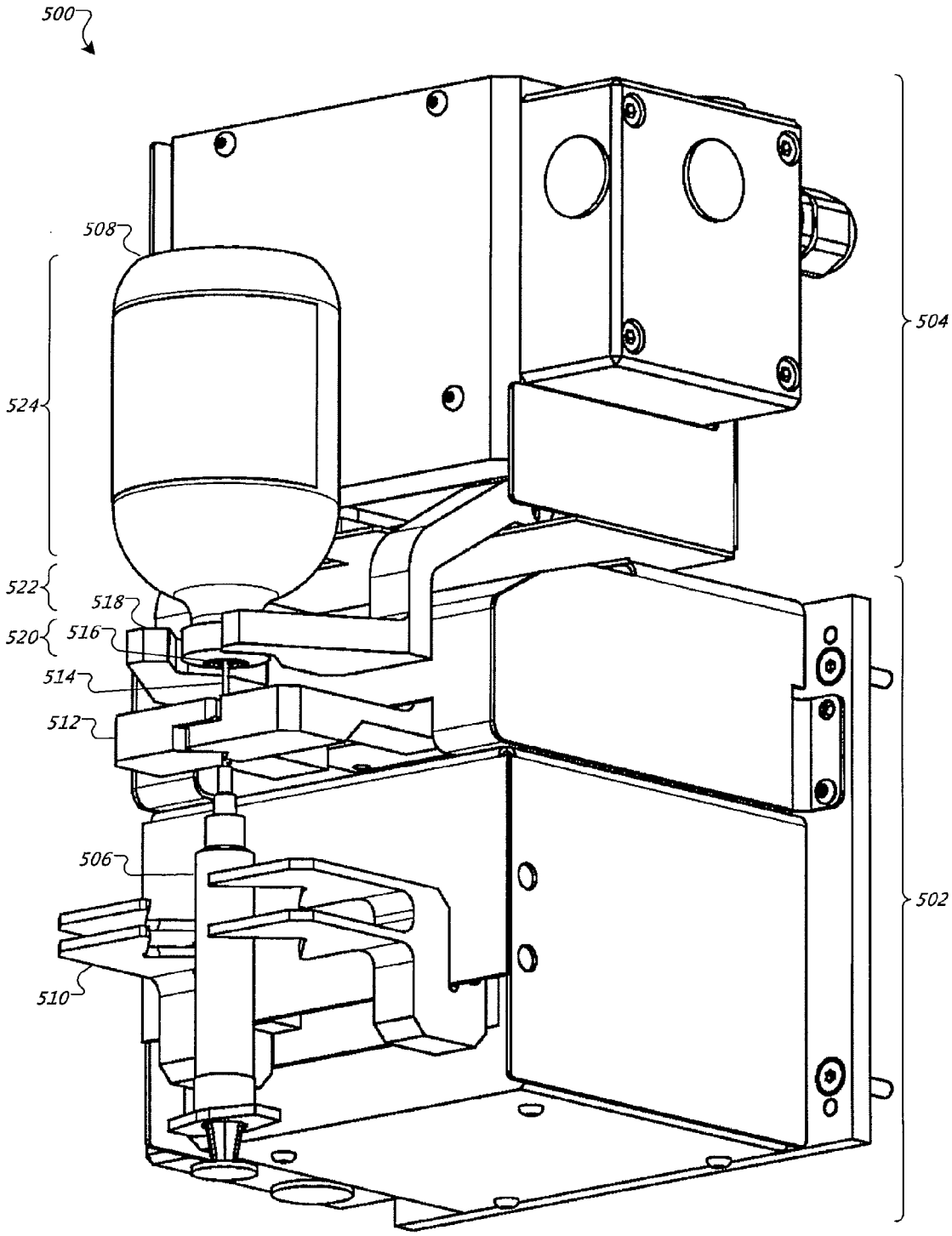
FIG. 5 shows an example of an apparatus for performing a fluid transfer operation.

FIG. 5 shows an example of an apparatus 500 for performing a fluid transfer operation. The apparatus 500 includes a fluid transfer device manipulator 502 and a container manipulator 504. The fluid transfer device manipulator 502 holds and manipulates a fluid transfer device 506. The container manipulator 504 holds and manipulates a container 508. In various examples, the apparatus 500 may operate to accurately control the location and orientation at which a fluid conduit is inserted into a fluid port.

In particular examples, the apparatus 500 may advantageously compensate for the dimensional variations that typically reduce the uniformity and precision with which multiple needle insertions may be made at selected locations on a fluid port. For example, from a supply of standard syringes to be inserted into a fluid port of a standard vial without controls on orientation, depth, and location of the needle, dimensional variations associated with manufacturing tolerances (e.g., syringe body, vial body, stopper depth, luer-lock coupling, randomness in orientation, and needle imperfections) may combine to reduce repeatability of needle location and orientation with respect to the vial fluid port.

In the depicted example, the fluid transfer device manipulator 502 includes a fluid transfer device gripper 510 and a needle gripper 512. The fluid transfer device gripper 510 includes two hands each having two fingers for grasping the fluid transfer device 506. The needle gripper 512 includes two interlocking fingers for grasping a needle 514 of the fluid transfer device 506.

In some implementations, grasping the needle 514 using the needle gripper 512 reduces variation in the insertion location of the needle 514 into a fluid transfer port 516 of the container 508 versus, for example, gripping a body region of the fluid transfer device 506. For example, the needle gripper 512 may provide precise control of the angle at which the needle 514 is incident upon the fluid transfer port 516. The needle gripper 512 may also provide precise control of the location in the plane of the surface of the fluid transfer port 516 at which the needle 514 is inserted. In some implementations, the precise control is provided by needle gripper fingers that are as wide as possible along the length of the needle 514 without coming in contact with the portion of the needle 514 that is inserted into the container 508. In some implementations, the precise control allows the insertion of the needle 514 to be repeatably positioned within, for example, one or two tenths of a millimeter on the fluid transfer port 516.

The container manipulator 504 includes a container gripper 518. In the example shown here, the container gripper 518 grasps a cap region 520 of the container 508. In another example, the container gripper 518 can grasp a neck region 522 or a body region 524 of the container 508. The neck region 522 may be grasped, for example, when a geometry of the cap region 520 prevents grasping the cap region 520. In some implementations, the container gripper 518 uses a centering feature, such as a V-grip, to precisely and repeatably hold the container 508 in substantially the same position.

In some implementations, the container 508 includes, or has attached, a gripper adapter (not shown). The gripper adapter may be fitted to the container 508 prior to loading the container into the container manipulator 504. The gripper adapter can provide an interface for a robotic arm (not shown) that transfers the container 508 to the container manipulator 504. Also, the gripper adapter can provide precise and repeatable positioning of the container 508 within the container gripper 518. In some implementations, the gripper adapter is a cylindrical vessel with internal components that either actively or passively position the container 508. For example, components in a cylindrical gripper adapter vessel can include a clamping device, foam, inflatable bladder, or springs.

In some implementations, the container 508 and/or the fluid transfer device 506 are actively positioned by the container manipulator 504 and the fluid transfer device manipulator 502. For example, the container manipulator 504 and/or the fluid transfer device manipulator 502 can include sensors that determine the position (e.g., along x, y, and z axes) of the container 508 and/or the fluid transfer device 506 relative to one another. Information from the sensors can be used to precisely and repeatably position the container 508 and/or the fluid transfer device 506. Sensors may include, for example, a passive sensor (e.g., a camera, a capacitive sensor, or a parallax range finder) or an active sensor (e.g., sonar, radar, or a laser range finder).

In some implementations, the fluid transfer device gripper 510, the needle gripper 512, and/or the container gripper 518 can include an improved gripper having an angled contact surface. An example of an angled gripper contact surface is described with reference to FIGS. 1A through 7 in U.S. Provisional Patent Application Ser. No. 60/971,815, filed by Eliuk, et al. on Sep. 12, 2007, the entire contents of which are herein incorporated by reference.

Figure 6:
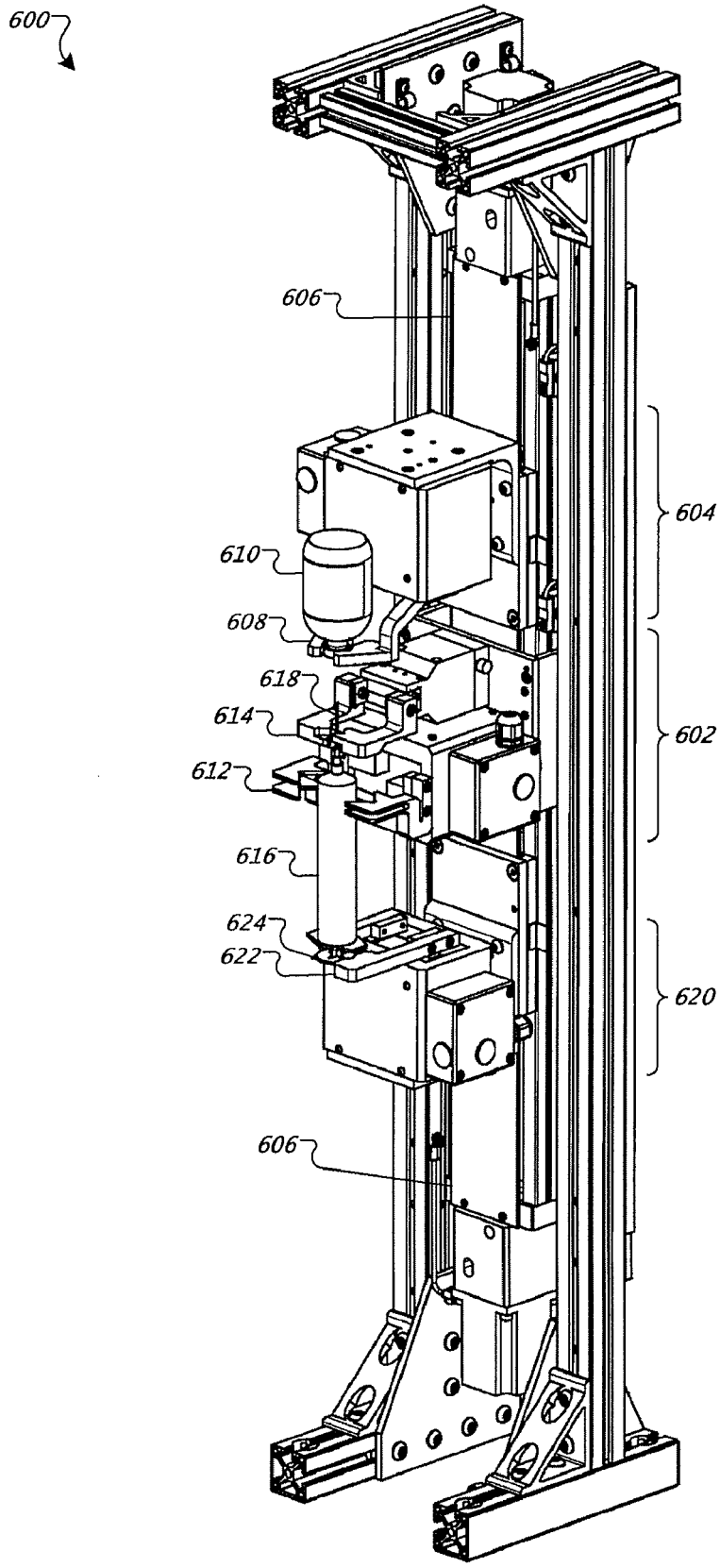
FIG. 6 shows an example of an apparatus for performing a fluid transfer operation in a needle up orientation.

FIG. 6 shows an example of an apparatus 600 for performing a fluid transfer operation in a needle up orientation. Particularly, the apparatus 600 includes a fluid transfer device manipulator 602 in a needle up orientation and a container manipulator 604 in a port down orientation. The apparatus 600 includes one or more slides 606 that allow relative vertical movement between the fluid transfer device manipulator 602, the container manipulator 604, and/or other components. For example, the slides 606 can allow the container manipulator 604 to move in a vertical direction onto the fluid transfer device manipulator 602 to allow insertion or withdrawal of a needle to or from a container.

The container manipulator 604 includes a container gripper 608 for grasping a container 610. The fluid transfer device manipulator 602 includes a fluid transfer device gripper 612 and a needle gripper 614 for grasping a fluid transfer device 616 and a needle 618 of the fluid transfer device 616, respectively. A robotic arm, for example, can transport the container 610 and/or the fluid transfer device 616 to the apparatus 600 from, for example, a UV disinfection apparatus or a bevel orientation device.

The container manipulator 604 and/or the fluid transfer device manipulator 602 move along the slides 606 toward one another to insert the needle 618 into a fluid transfer port (not shown) of the container 610. In some implementations, the container 610 and the fluid transfer device 616 have known properties such that the container manipulator 604 and/or the fluid transfer device manipulator 602 can be moved a predetermined distance along the slides 606 to insert the needle 618 into the container 610. For example, the fluid transfer device 616 may have a known size, including the length of the needle 618, and the container 610 may have a known size, including a thickness of the fluid transfer port material. The fluid transfer device manipulator 602 can be moved up and/or the container manipulator 604 can be moved down such that the beveled tip of the needle 618 is completely inserted though the fluid transfer port. In some implementations, the needle 618 is inserted to a depth that remains below the level of fluid in the container 610.

In some implementations, the apparatus 600 can include active or passive sensors that detect a position of the needle 618 relative to the fluid transfer port of the container 610. For example, a camera can generate images of the needle 618 and the container 610. The images can be processed to determine a depth at which to insert the needle 618 through the fluid transfer port and below the level of fluid in the container 610. In some embodiments, the depth may be controlled to insert the needle tip a sufficient distance to clear the worst-case depth of the interior surface of the fluid transfer port based on manufacturing tolerance information.

In the needle up/port down implementation shown here, the fluid transfer device 616 can be used, for example, to draw fluid from the container 610. The apparatus 600 further includes a plunger manipulator 620. The plunger manipulator 620 can travel along the slides 606. The plunger manipulator 620 includes a plunger gripper 622 for grasping a plunger 624 of the fluid transfer device 616. The plunger manipulator 620 can actuate the plunger 624 to transfer fluid and/or gas (e.g., air) to and from the fluid transfer device 616.

In some implementations, the apparatus 600 uses a method of cycles to expel substantially all gas from the fluid transfer device 616 during a fluid draw. The method begins with pushing a volume of gas from the fluid transfer device 616 into the container 610. The volume of gas can be substantially the same as the volume of fluid to be drawn from the container 610 into the fluid transfer device 616. In some implementations, the volume of gas can be chosen such that the pressure within the container 610 remains at a particular positive or negative amount after completing the fluid transfer.

After pushing the volume of gas into the container 610, the draw of fluid from the container 610 into the fluid transfer device 616 is divided into multiple cycles. The amount drawn at each cycle and the speed at which the amount is drawn can vary. The amount and speed can be based on the size of the dose and/or fluid transfer device as measured in, for example, milliliters (mL).

In one example, a small dose and/or syringe (e.g., a 0.5 mL dose in a 1.0 mL syringe) can include generally more cycles than a larger dose and/or syringe (e.g., 10.0 mL dose in a 10.0 mL syringe). For example, for a 10.0 mL syringe, one or two cycles may substantially remove trapped gas from the syringe. In some implementations, the effect of gas trapped in a small fluid transfer device can be greater than the effect of a substantially similar amount of gas trapped in a larger fluid transfer device. Therefore, more cycles can be used for the smaller syringe to reduce the effect of the trapped gas.

The speed at which the plunger 624 is actuated can be based on the type or size of the needle 618 as well as the material transferred. For example, an eighteen gauge needle can have a maximum (e.g., 100%) rate of 1.5 milliliters per second (mL/s) when transferring a particular fluid. In another example, the eighteen gauge needle can have a maximum rate of 15.0 mL/s when transferring a particular gas. In some implementations, plunger push speeds are higher than plunger draw speeds. The speed of the transfer can also be based on the size of the fluid transfer device 616. In some implementations, the rate in mL/s can be converted to a distance per unit time using a conversion factor, such as millimeters per milliliter (mm/mL). For example, a 1.0 mL syringe can have a conversion factor of 58.0 mm/mL.

The amount drawn in a cycle can be based on the size of the fluid transfer device 616 (e.g., a percentage of the fluid transfer device size) and the cycle at which the draw is performed. For example, a later cycle may draw less fluid than an earlier cycle. The following table shows an example of cycles for removing air from a 1.0 mL syringe during a draw for a 0.5 mL dose:

Table Showing Exemplary Air Removal Cycles

| Cycle | Action | Draw/Push Amount | Draw Speed |
|---|---|---|---|
| 1 | Push from Syringe | 0.5 mL (gas) | 1.5 mL/s (100%) |
| 2 | Draw to Syringe | 0.5 mL (50%) | 0.375 mL/s (25%) |
| 3 | Push from Syringe | 0.5 mL + 1.5 mm | 1.5 mL/s (100%) |
| 4 | Draw to Syringe | 0.25 mL (25%) | 0.75 mL/s (50%) |
| 5 | Push from Syringe | 0.25 mL + 1.5 mm | 1.5 mL/s (100%) |
| 6 | Draw to Syringe | 0.25 mL (25%) | 1.125 mL/s (75%) |
| 7 | Push from Syringe | 0.25 mL + 1.5 mm | 1.5 mL/s (100%) |
| 8 | Draw to Syringe | 0.2 mL (20%) | 1.5 mL/s (100%) |
| 9 | Push from Syringe | 0.2 mL + 1.5 mm | 1.5 mL/s (100%) |
| 10 | Draw to Syringe | 0.2 mL (20%) | 1.5 mL/s (100%) |
| 11 | Push from Syringe | 0.2 mL + 1.5 mm | 1.5 mL/s (100%) |
| 12 | Draw to Syringe | 0.2 mL (20%) | 1.5 mL/s (100%) |
| 13 | Push from Syringe | 0.2 mL + 1.5 mm | 1.5 mL/s (100%) |
| 14 | Draw to Syringe | 0.5 mL + 0.05 mL (dose + 5%) | 1.125 mL/s (75%) |
| 15 | Push from Syringe | 0.025 mL | 1.125 mL/s (75%) |

The first cycle in the table above is the gas injection at the start of the fluid transfer operation. The example above shows a gas injection substantially the same as the dose amount. In other examples, the gas injection may be smaller or larger than the dose amount, which may result in a net negative or positive pressure, respectively, after completing the fluid operation. In some implementations, a net negative pressure inside a vial with respect to an ambient pressure prevents leakage and/or aerosolizing. As the needle is withdrawn, the net negative pressure results in ambient air being drawn into the vial if an air path is present.

In the above example, cycles that include a push action from the syringe to the container push the amount of material drawn in a previous cycle plus an additional 1.5 mm back into the container. In some implementations, the 1.5 mm can be converted to mL using the conversion factor previously described. In some implementations, the 1.5 mm is past the nominal end point of the plunger in the syringe. For example, the nominal end point may be a neutral position where the plunger is fully seated in the syringe and free of pre-stress.

The extra 1.5 mm may force the plunger into the head end of the syringe to expel an additional amount of trapped gas. The extra push past the nominal end point may be based on the size or type of the syringe. For example, a 10.0 mL syringe may have more extra plunger travel past the nominal end point than the 1.0 mL syringe, such as about 3.0 mm of extra travel.

The draw amounts and speeds may gradually increase from the second cycle up to the thirteenth cycle. In some implementations, the draw amount may be based on the size or type of syringe. For example, a 10.0 or 20.0 mL may have a first draw (e.g., the second cycle) of ten or twenty percent of the syringe size. The subsequent draws for a 10.0 or 20.0 mL syringe may be proportionately smaller than those in the table above and there may be fewer cycles.

At the fourteenth cycle the draw amount is the dose amount plus an additional five percent of the syringe size. The extra five percent is expelled in cycle fifteen and the syringe is left with the dose amount. In some implementations, the extra five percent draw and expel is referred to as a "draw end-cycle." The draw end-cycle can remove additional trapped gas from the syringe. In some implementations, the size of the draw end-cycle can be based on the size of the syringe. For example, a 10.0 mL can have a draw end-cycle size of two or three percent.

In some implementations, the number of cycles, the amount of the draws/pushes, and/or the speed of the draws/pushes may be based on the material dispensed. For example, where a material transferred has a high monetary value or health risk associated with an over or under dosage, more cycles may be performed, smaller draws/pushes used, and/or smaller speeds used.

In a set of experimental tests, a 0.4 mL dose was drawn into a 1.0 mL syringe with and without the gas removal operations previously described. The draw was repeated twenty-eight times with and without gas removal. The standard deviation for the tests without gas removal yielded a standard deviation in the weight change for the syringe of 0.0247 grams (g) or about six percent. The standard deviation in the weight change for the syringe when using gas removal was 0.004 g or about one percent.

In another set of experimental tests, an eighteen gauge needle was repeatedly inserted into a 100.0 mL vial with and without the needle orientation controls previously described. In uncontrolled insertions, a positive pressure of less than 1.0 pounds-force per square inch gauge (psig) sometimes caused leakage after only two needle insertions. The pressure of less than 1.0 psig frequently caused leakage after three to five insertions. For controlled insertions, five separate needles were each inserted into a vial ten times for a total of fifty insertions for the vial. The fifty insertions were also repeated for three separate vials. Each of the vials was capable of preventing fluid leakage while holding a positive pressure of 28.0 pounds-force per square inch absolute (psia) against an ambient pressure of 14.2 psia after fifty insertions with the needle remaining inserted. In some implementations, an aperture resulting from multiple controlled needle insertions can substantially prevent leakage while holding a differential pressure of at least about 1.0, 2.0, 3.0, 4.0, 5.0, 6.0, 7.0, 8.0, 9.0, 10.0, 11.0, 12.0, 13.0 psig after two, three, four, five, ten, fifteen, twenty, thirty, forty, or fifty insertions in the aperture.

Pressure within a container, such as a vial, can cause the fluid transfer port of the container to bulge or distend. The bulge can increase as the pressure increases within the container. Conversely, the fluid transfer port can also be drawn inwards as negative pressure increases within the container. The bulging or inward draw of the fluid transfer port can cause an aperture resulting from a needle insertion to leak. The amount of positive or negative pressure causing an aperture to leak can be based on the location of the aperture on the fluid transfer port. In some implementations, the needle insertion point is chosen to be near the edge or other strong structural feature (e.g., a ridge or thicker portion) in the fluid transfer port to increase the maximum allowed pressure within the container. In some implementations, apertures nearer the edge may be assigned a higher limit on the number of insertions than similar apertures located closer to the middle of the fluid port.

Draw/push amounts, speeds, and number of cycles can be chosen to avoid leakage at the fluid transfer port while also minimizing the time needed to perform the fluid transfer operation. In addition, the draw/push amounts, speeds, and number of cycles can be chosen to achieve a particular accuracy. In some implementations, draw/push amounts, speeds, and number of cycles can be predetermined to a particular accuracy, leakage, and fluid transfer time requirements.

Figure 7:
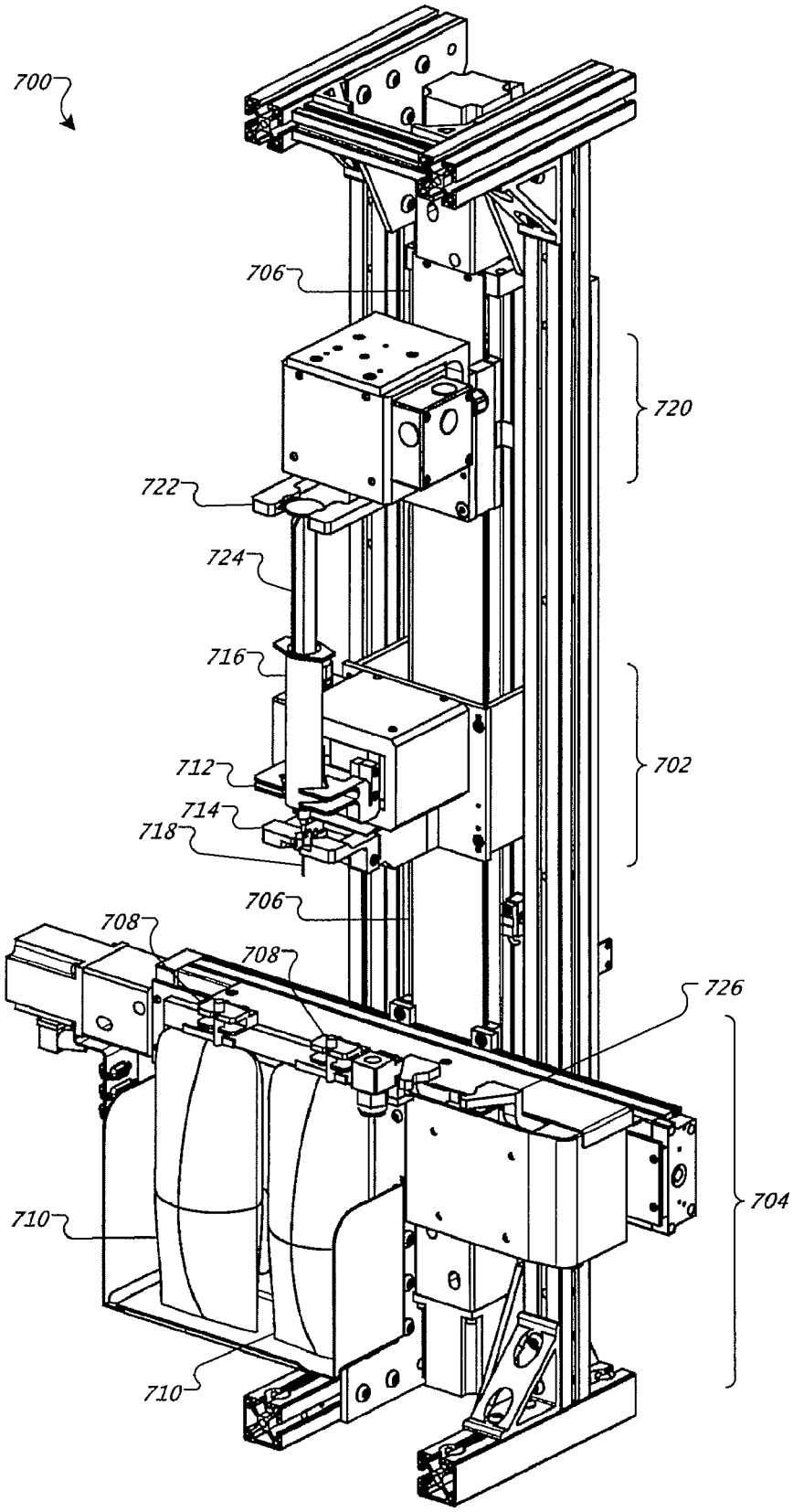
FIG. 7 shows an example of an apparatus for performing a fluid transfer operation in a needle down orientation.

FIG. 7 shows an example of an apparatus 700 for performing a fluid transfer operation in a needle down orientation. Particularly, the apparatus 700 includes a fluid transfer device manipulator 702 in a needle down orientation and a container manipulator 704 in a port up orientation. The fluid transfer device manipulator 702 and/or the container manipulator 704 travel in a vertical direction along one or more slides 706. For example, the container manipulator 704 can move toward or away from the fluid transfer device manipulator 702 to insert or withdraw, respectively, a needle to or from a container.

The container manipulator 704 includes multiple container grippers 708 for grasping multiple containers 710. The container manipulator 704 allows movement in a horizontal direction. The container manipulator 704 can be moved in the horizontal direction to provide needle insertions into a particular one of the containers 710.

The fluid transfer device manipulator 702 includes a fluid transfer device gripper 712 as well as a needle gripper 714 for grasping a fluid transfer device 716 and a needle 718, respectively. In some implementations, the needle down orientation of the fluid transfer device manipulator 702 provides for pushing fluid from the fluid transfer device 716 into one of the containers 710. In one example, the robotic arm transports the fluid transfer device 716 from the bevel orientation device 400 (previously described with respect to FIGS. 4A-D) to the apparatus 600 where fluid is drawn from a vial. The robotic arm then transports the fluid transfer device 716 to the apparatus 700 where the fluid is transferred to one of the containers 710. During the transporting of the fluid transfer device 716, the needle bevel orientation (e.g., rotation about the z-axis) and/or the needle tip position (e.g., position along the z-axis) determined by the bevel orientation device 400 are maintained to provide a substantially controlled orientation and insertion depth of the needle tip into the fluid transfer port.

In some implementations, the fluid transfer device 716 may be transported back to the bevel orientation device 400 between transport from the apparatus 600 to the apparatus 700 for additional bevel orientation. In some implementations, the apparatus 600, and/or the apparatus 700 can include features described with respect to FIGS. 4A-D such that the robotic arm, the apparatus 600, and/or the apparatus 700 cooperate to achieve controlled bevel orientation. In some implementations, the robot coordinates the hand off between itself and an apparatus to perform the bevel orientation (e.g., a needle rotation). In some implementations, separate insertion locations are used by the apparatus 600 and the apparatus 700. For example, a vial used in a needle up orientation may have a first needle aperture and the same vial used in a needle down orientation may have a second needle aperture.

In some implementations, needle bevel orientation can be accomplished by coordinated motion and/or hand offs between a gripper on the robotic arm (not shown) and the fluid transfer device gripper 612 or the fluid transfer device gripper 712. Sensors (e.g., a camera, a proximity sensor, or a laser range finder) can be used to determine the needle orientation of a fluid transfer device grasped by a robotic arm, the fluid transfer device gripper 612, and/or the fluid transfer device gripper 712. A combination of robot or manipulator gripper rotation about the fluid transfer device z-axis (e.g., the z-axis of FIGS. 3A-B) and gripper grasps and releases will allow the orientation of the needle bevel to be altered to bring it into alignment with a fluid transfer port aperture. Positioning of the needle tip with respect to the fluid transfer port surface membrane can also be conducted using grasps and releases to translate a fluid transfer device up or down along the z-axis.

In some implementations, a method of aligning a needle bevel to an aperture in a fluid transfer port is to rotate (and/or translate) a container or conduit with respect to the needle bevel. This can be accomplished using methods similar to those methods previously described for orienting a fluid transfer device. However, in this example, the container (e.g., a vial or an IV bag) or the conduit (e.g., a flexible tube) is rotated and/or translated along the z-axis rather than, or in addition to, the fluid transfer device. In some implementations, a location of the aperture in the fluid transfer port can be determined, for example, using cameras, lasers, or imaging methods using non-visible wavelengths.

The apparatus 700 also includes a plunger manipulator 720. The plunger manipulator 720 includes a plunger gripper 722 for grasping a plunger 724 of the fluid transfer device 716. The plunger manipulator 720 can actuate the plunger 724 to transfer fluid and/or gas between the fluid transfer device 716 and one of the containers 710.

In one implementation, the apparatus 700 may transfer fluid from the fluid transfer device 716 to a container, such as a vial, in a needle down orientation. The container manipulator 704 includes a container gripper 726 for grasping a container, such as a vial, in a fluid transfer port up orientation. In one example, the fluid transferred to the vial may be a diluent for admixture with a medication in the vial. Subsequently, an apparatus, such as the apparatus 600 of FIG. 6, can draw fluid from the vial into the fluid transfer device 616 in a needle up orientation. In some implementations, the fluid transfer device 716 and the fluid transfer device 616 use substantially the same needle aperture as described with respect to FIG. 2A. In some implementations, the fluid transfer device 616 may use a needle aperture that is separate from the needle aperture used by the fluid transfer device 716 as described with respect to FIG. 2B. In addition, the fluid transfer device 616 and/or additional fluid transfer devices may draw fluid from the vial in the needle up orientation. Subsequent draws by the fluid transfer device 616 and/or the additional fluid transfer devices may use substantially the same needle aperture as the first draw using the fluid transfer device 616 or an additional needle aperture as described with respect to FIG. 2B.

Although various embodiments have been described with reference to the Figures, other implementations are contemplated. For example, a robotic system may perform a number of draws from a container such as a vial by using a pattern of insertions distributed among various aperture locations.

In some exemplary modes, a pattern may include controlling some needle insertions to use previously created apertures. In some implementations, the exemplary mode may further be controlled so that any one of a set of apertures receives no more than one more insertion than any other aperture in the set of apertures. In some other modes, the pattern may include creating up to a predetermined number, density, or arrangement of substantially separated apertures without using any previously created apertures. In one exemplary application, an exemplary system makes a first sequence of cannula and/or needle insertions into a fluid transfer port using a first mode in which each aperture is substantially spaced apart from previously created apertures, and then makes a subsequent sequence of cannula and/or needle insertions using a second mode in which insertions are substantially evenly distributed among existing apertures.

In some examples, more than one size, shape, or type of needle or cannula may be inserted into a particular fluid port. In an exemplary system, information about each needle or cannula may be tracked and associated with the orientation, location, and/or angle of insertion into the fluid port. Such an exemplary system can, for example, select a most suitable pre-existing aperture for a proposed needle or cannula to re-use.

In one exemplary application, a system may track and control the location, orientation, and type of apertures created and the number of insertions in each aperture. The system may obtain fluid port characteristics, such as the usable area of the fluid port, by recalling stored characteristic information from a database, reading the characteristic information from a label, or, for example, optical scanning (e.g., infrared, optical recognition) to identify suitable regions for insertion. The system may further determine whether particular locations within the determined suitable regions are suitable for inserting a particular needle or cannula. The system may further manage the location, orientation, and number of insertions of each needle or cannula type, shape, or size in each aperture.

The exemplary system may reject a particular insertion for any of a number of reasons. For example, the system may determine that a particular aperture has been used a predetermined maximum number of times. Some systems may determine that a particular insertion would cause the corresponding aperture to come too close (e.g., within a predetermined keep-out region) of another planned or pre-existing aperture. In some cases, the system may determine the needle or cannula to be of a different, for example, shape (e.g., radius of curvature, bevel length), size (e.g., diameter, thickness), and which may expand the aperture more than desired amount. If no suitable aperture is determined to be available for the proposed needle, the system may reject the requested needle insertion.

The system may determine that the fluid port has apertures that have less than a specified maximum number of insertions in at least one aperture, and/or the fluid port has room available for receiving at least one more new aperture. Upon determining that a suitable needle or cannula type is available, the system may automatically process the requested insertion using the needle or cannula type determined to be suitable. In a particular example, the system may identify a suitable inventory item, retrieve the identified item, and orient the item to achieve the desired aperture location and orientation upon insertion into the fluid port. In some examples, the orientation may be based on the stored location, type, and orientation information about a pre-existing or planned aperture in the fluid port.

If, however, no suitable needle or cannula type is available, then the system may generate an appropriate electronic error message, which it may then save in an electronic data store, and/or send the message to notify an operator. The system may further remove the container with the exhausted fluid port from process inventory.

Although a few implementations have been described in detail above, other modifications are possible. In addition, other components may be added to, or removed from, the described systems. Accordingly, other implementations are within the scope of the following claims.

What is claimed is:

1. An automated method of providing fluid communication through a self-sealing membrane, the method comprising:

a) operating an articulated conveyor to retrieve a first fluid conduit having a beveled leading edge;

b) creating a first aperture in a re-sealable fluid port membrane by piercing the membrane with the first fluid conduit;

c) operating the articulated conveyor to retrieve an additional fluid conduit having a beveled leading edge;

d) determining alignment and orientation of the additional fluid conduit relative to the first aperture;

e) registering and orienting the additional fluid conduit for entry into the first aperture; and f) inserting the additional fluid conduit through the first aperture and in substantial alignment with the first aperture.

2. The method of claim 1, further comprising beginning to perform step d) before beginning to perform step c).

3. The method of claim 1, further comprising repeating steps c) through f) at least two times.

4. The method of claim 1, wherein step f) comprises inserting the additional fluid conduit without substantially enlarging the first aperture.

5. The method of claim 1, further comprising transferring a fluid through the additional fluid conduit while the additional fluid conduit is inserted in the first aperture.

6. The method of claim 1, further comprising transferring a fluid through the first fluid conduit while the first fluid conduit is inserted in the first aperture.

7. The method of claim 1, wherein the re-sealable fluid port membrane substantially prevents fluid leakage while holding a differential pressure of at least 5 pounds-force per square inch gauge (psig) after at least five insertions.

8. The method of claim 7, wherein the re-sealable fluid port membrane substantially holds the differential pressure of at least 5 psig after at least ten insertions.

9. The method of claim 1, wherein the first fluid conduit comprises a needle.

10. The method of claim 1, wherein the first fluid conduit comprises a cannula.

11. The method of claim 1, wherein the re-sealable fluid port membrane comprises a vial bung.

12. The method of claim 1, wherein the re-sealable fluid port membrane comprises an intravenous (IV) bag fluid port.

13. The method of claim 1, wherein the fluid port membrane seals an opening of a fluid reservoir.

14. The method of claim 13, wherein the fluid reservoir comprises a vial.

15. The method of claim 13, wherein the fluid reservoir comprises an intravenous (IV) bag.

16. The method of claim 13, wherein the fluid reservoir comprises a flexible fluid conduit.

17. The method of claim 13, wherein the fluid reservoir comprises a rigid container.

18. The method of claim 1, wherein the first fluid conduit is the same as at least one of the additional fluid conduits.

19. The method of claim 1, further comprising discarding the first fluid conduit and retrieving the second fluid conduit.

20. The method of claim 1, further comprising creating a second aperture in the re-sealable fluid port membrane by piercing the membrane with another fluid conduit having a beveled leading edge.

21. The method of claim 1, wherein step d) comprises determining an orientation of the beveled leading edge of the additional fluid conduit.

22. The method of claim 1, wherein step d) further comprises rotating the beveled edge of the additional fluid conduit to be in substantial register with the first aperture.

23. The method of claim 1, further comprising positioning the fluid conduit to be a predetermined distance from the surface of the re-sealable fluid port membrane.

24. A computer program product tangibly embodied in a computer readable medium, the computer program product including instructions that, when executed, perform operations for providing fluid communication through a self-sealing membrane, the operations comprising:

a) cause an articulated conveyor to retrieve a first fluid conduit having a beveled leading edge;

b) create a first aperture in a re-sealable fluid port membrane by piercing the membrane with the first fluid conduit;

c) cause the articulated conveyor to retrieve an additional fluid conduit having a beveled leading edge;

d) determine alignment and orientation of the additional fluid conduit relative to the first aperture;

e) register and orient the additional fluid conduit for entry into the first aperture; and f) insert the additional fluid conduit through the first aperture and in substantial alignment with the first aperture.

25. A method of repeatedly accessing a fluid container to permit fluid transfer, the method comprising:

a) selecting a first location and orientation to insert a leading tip for needles having a beveled leading edge;

b) repeatedly inserting a leading tip of at least one needle at the selected first location and orientation;

c) after performing step b) a predetermined number of times, selecting a second location and orientation to insert a leading tip for at least one needle having a beveled leading edge, wherein a first aperture formed by inserting a needle at the selected first location and orientation will be substantially spaced apart from a second aperture formed by inserting a needle at the selected second location and orientation; and d) positioning a leading tip of a needle for insertion at the selected second location and orientation, wherein the first and second apertures are made by insertion of needles through a substantially self-sealing membrane.

26. The method of claim 25, wherein selecting a second location comprises identifying a location at which the second aperture is substantially outside of a predefined keep-out region around the first aperture.

27. The method of claim 25, further comprising inserting a leading tip of at least one needle at the selected second location and orientation.

28. The method of claim 25, wherein step b) comprises making a plurality of insertions with at least two different needles.

29. The method of claim 25, wherein step d) comprises making a plurality of insertions with at least two different needles.

30. The method of claim 25, further comprising:

e) after performing step d) a second predetermined number of times, selecting a third location and orientation to insert a leading tip for at least one needle having a beveled leading edge, wherein the first and second apertures will be substantially spaced apart from a third aperture formed by insertion of a needle at the selected third location and orientation.

31. The method of claim 30, further comprising:

f) positioning a leading tip of a needle for insertion at the selected third location and orientation.

32. A computer program product tangibly embodied in a computer readable medium, the computer program product including instructions that, when executed, perform operations for repeatedly accessing a fluid container to permit fluid transfer, the operations comprising:

a) select a first location and orientation to insert a leading tip for needles having a beveled leading edge;

b) repeatedly insert a leading tip of at least one needle at the selected first location and orientation;

c) after performing step b) a predetermined number of times, select a second location and orientation to insert a leading tip for at least one needle having a beveled leading edge, wherein a first aperture formed by inserting a needle at the selected first location and orientation will be substantially spaced apart from a second aperture formed by inserting a needle at the selected second location and orientation; and d) position a leading tip of a needle for insertion at the selected second location and orientation, wherein the first and second apertures are made by insertion of needles through a substantially self-sealing membrane.

* * * * *